US007499009B2

(12) United States Patent
Kanbe et al.

(10) Patent No.: US 7,499,009 B2
(45) **Date of Patent: *Mar. 3, 2009**

(54) ERASING DEVICE FOR LIQUID CRYSTAL DISPLAY IMAGE AND LIQUID CRYSTAL DISPLAY DEVICE INCLUDING THE SAME

(75) Inventors: Makoto Kanbe, Tenri (JP); Yasuhisa Itoh, Tenri (JP); Shigeto Yoshida, Tenri (JP); Hiroshi Yoneda, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 516 days.

This patent is subject to a terminal disclaimer.

(21) Appl. No.: 11/148,328

(22) Filed: Jun. 9, 2005

(65) Prior Publication Data

US 2006/0007217 A1 Jan. 12, 2006

Related U.S. Application Data

(62) Division of application No. 10/091,321, filed on Mar. 6, 2002, now Pat. No. 6,940,479, which is a division of application No. 09/671,125, filed on Sep. 28, 2000, now abandoned, which is a division of application No. 08/974,496, filed on Nov. 19, 1997, now Pat. No. 6,151,016.

(30) Foreign Application Priority Data

Nov. 26, 1996 (JP) ..... 8-315309
Jul. 31, 1997 (JP) ..... 9-206840

(51) Int. Cl.
*G09G 3/36* (2006.01)

(52) U.S. Cl. ..... 345/87; 345/94

(58) Field of Classification Search ..... 345/87–104
See application file for complete search history.

(56) References Cited

U.S. PATENT DOCUMENTS 5,248,963 A 9/1993 Yasui et al.
5,313,282 A 5/1994 Hayashi (Continued)

FOREIGN PATENT DOCUMENTS

JP 57-108892 7/1982

(Continued)

*Primary Examiner*—Jimmy H Nguyen
(74) *Attorney, Agent, or Firm*—Nixon & Vanderhye P.C.

(57) ABSTRACT

An erasing device for a liquid crystal display image of the present invention is furnished with an auxiliary power source for continuously supplying power source to a liquid crystal display panel for a certain period after the main power source of the main body of the liquid crystal display device is turned OFF. Upon input of a power source OFF signal directing to turn OFF the main power source, a driving signal generating circuit and a driver controller light up the liquid crystal display panel entirely on a saturation voltage of the liquid crystal and subsequently shut off the same entirely using the power supply from the auxiliary power source. Consequently, it has become possible to erase an afterimage quickly on an active matrix liquid crystal display panel with a memory maintaining function of a liquid crystal display device, thereby not only upgrading the display quality, but also preventing deterioration of the liquid crystal caused by an application of an abnormal voltage associated with the occurrence of an afterimage.

6 Claims, 32 Drawing Sheets

U.S. PATENT DOCUMENTS

| | | | |
|---|---|---|---|
| 5,412,397 | A | 5/1995 | Kanatani et al. |
| 5,592,191 | A | 1/1997 | Tsuboyama et al. |
| 5,793,346 | A | 8/1998 | Moon |
| 6,151,016 | A | 11/2000 | Kanbe et al. |

FOREIGN PATENT DOCUMENTS

| | | |
|---|---|---|
| JP | 62-165630 | 7/1987 |
| JP | 01-170986 | 7/1989 |
| JP | 62-331765 | 7/1989 |
| JP | 170986/1989 | 7/1989 |
| JP | 06-148599 | 5/1994 |
| JP | 06-059328 | 10/1995 |
| JP | 07-271335 | 10/1995 |
| JP | 08-006518 | 1/1996 |
| JP | 08-248393 | 9/1996 |
| JP | 08-286647 | 11/1996 |
| KR | 96-8515 | 9/1996 |

ERASING DEVICE FOR LIQUID CRYSTAL DISPLAY IMAGE AND LIQUID CRYSTAL DISPLAY DEVICE INCLUDING THE SAME

This application is a division of application Ser. No. 10/091,321, filed Mar. 6, 2002, now U.S. Pat. No. 6,940,479; which is a division of application Ser. No. 09/671,125, filed Sep. 28, 2000, now abandoned; and which is a division of application Ser. No. 08/974,496, filed Nov. 19, 1997, now U.S. Pat. No. 6,151,016, issued Nov. 21, 2000, the entirety of each of these applications is incorporated by reference.

FIELD OF THE INVENTION

The present invention relates to an erasing device for a liquid crystal display image for erasing a display image on a liquid crystal display panel furnished with a memory maintaining function, such as an active matrix liquid crystal display panel, as soon as a power source of the main body of a liquid crystal display device is turned OFF, and to a liquid crystal display device including such an erasing device.

BACKGROUND OF THE INVENTION

Recently, an application of a liquid crystal display device to equipment like a personal computer, a TV set, a word processor, a video camera, etc. has been advancing. On the other hand, there has been an increasing demand for such equipment with improved functions including downsizing, power saving, cost reduction, etc. To meet such a demand, a reflective liquid crystal display device which displays an image by reflecting incident light from the external with a reflector instead of using a backlight has been developed as an alternative of a transmission liquid crystal display device which displays an image using light emanated from the backlight.

Further, of all kinds of the reflective liquid crystal display devices, the one adopting an active matrix liquid canasta display pane whose pixels are driven by active elements, such as TFTs (Thin Film Transistors), has been receiving more attention than the one adopting a direct matrix liquid crystal display panel, because an image can be displayed with a better quality at a higher duty.

However, when the power source of the main body of the liquid crystal display device equipped with the active matrix liquid crystal display panel is turned OFF, an image that has been displayed right before the power source is turned OFF remains on the panel as an afterimage for awhile. The afterimage is caused by charges withheld in liquid crystal due to a voltage withheld therein, an abnormal voltage generated by the active elements when the power source is turned OFF, etc. The afterimage degrades the image quality of this kind of liquid crystal display device serving as a display machine.

The transmission liquid crystal display device can make the afterimage almost unnoticeable by turning OFF the power sources of the liquid crystal display device and backlight concurrently, or bringing the liquid crystal display panel into an applied-voltageless state after the power source of the backlight is turned OFF. However, since the reflective liquid crystal display device can not block the incident light, it is impossible to make the afterimage less noticeable, thereby showing a display error vividly.

Further, the charges withheld in the liquid crystal due to an abnormal voltage not only degrade the display quality by the afterimage, but also give adverse effects on the operation life of the liquid crystal. In other words, the liquid crystal deteriorates, because, after the power source is turned OFF, the liquid crystal withholds the charges for as long as a few seconds until its potential drops to a GND level through natural discharge. In short, the liquid crystal deteriorates when an abnormal voltage is applied.

Japanese Laid-open Patent Application No. 170986/1989 (Tokukaihei 1-170986) discloses a method of erasing the afterimage, which is in effect an abnormal display occurred when the power source is turned OFF. According to this method, a power source maintaining circuit is provided to keep supplying an operating power to the liquid crystal panel for a predetermined period after the power source of the entire device is turned OFF, so that the active elements can stay ON for a certain period on a power supplier to a gate driver from the power source maintaining circuit, whereby the charges withheld in the liquid crystal display panel are discharged and the afterimage can be erased. FIG. 31 shows driving waveforms of the signals used in this method.

Incidentally, when a color image is displayed on the active matrix liquid crystal display panel, a voltage applied to the liquid crystal is controlled in a multi-level ranging from a threshold voltage to a saturation voltage. Here, the voltage applied to the liquid crystal and a response rate of the liquid crystal have a relation as illustrate in FIGS. 32(*a*) and 32(*b*). FIG. 32(*a*) shows a graph illustrating a relation between the number of levels and response rate in case of an 8-level display, and FIG. 32(*b*) shows a graph illustrating a relation among the number of levels, voltage, and transmittance. In FIG. 32(*a*), for example, "1-8" on the horizontal axis represents the level and means that the voltage is varied from the level 1 through level 8, where the level 8 represents a black display.

As can be understood from FIG. 32(*a*), the response rate of the liquid crystal varies with a level interval, and the response rate is slow particularly between the levels around the threshold voltage. This is because, when a voltage around the threshold voltage is applied to the liquid crystal, the distortion of the liquid crystal is so minor that only a small amount of energy is required to restore the liquid crystal.

Therefore, an amount of restoring energy is small in case there remains a half-tone afterimage around the threshold voltage when the power source of the liquid crystal display device is turned OFF. If such an afterimage is erased by the method disclosed in aforementioned Japanese Laid-open Patent Application No. 170986 (Tokukaihei 1-170986), that is, by releasing the charges withheld in the liquid crystal by maintaining the gate at an active level for a certain period after the power source is turned OFF, it takes a long time to release all the charges, thereby making it impossible to erase the afterimage quickly.

Moreover, merely maintaining the output of the gate driver at the active level does not reduce the potential of the liquid crystal panel to zero completely because of the operating conditions of the source driver, or the conditions of a voltage supplied to the liquid crystal from an opposing electrode in the liquid crystal display panel. Thus, in practice, a residual voltage is applied to the liquid crystal, and the above method presumably can not attain a desired afterimage erasing effect.

If the transmission liquid crystal display device adopts the above erasing method, still the afterimage appears after the power source is turned OFF; although the afterimage appears slightly for a short period, it is enough to degrade the image quality. Also, if it takes a long time to erase the afterimage, an abnormal voltage is applied to the liquid crystal due to the charges withheld therein even for a short period, and as a consequence, the liquid crystal deteriorates.

Further, the state of the reflective liquid crystal display device after the power source is turned OFF, and the state of the transmission liquid crystal display device with its backlight always kept turned ON are the same, meaning that the afterimage is more vivid in the reflective liquid crystal display device than in the transmission type. Thus, the liquid crystal deteriorates more or less the same extent in both the reflective and transmission liquid crystal display devices, but the display quality is deteriorated far worse in the reflective liquid crystal display device than in the transmission type.

SUMMARY OF THE INVENTION

It is therefore an object of the present invention to provide an erasing device for a liquid crystal display image which can erase an afterimage quickly while suppressing the deterioration of the liquid crystal, and to provide a liquid crystal displace device including such an erasing device.

To fulfill the above object, an erasing device for a liquid crystal display image of the present invention, provided in a liquid crystal device having a liquid crystal display panel whose pixels are driven by active elements, for erasing a display image on the liquid crystal display panel when a power source of a main body of the liquid crystal display device is turned OFF, is furnished with:

a power source OFF detecting section for detecting an OFF signal that turns OFF the power source of the main body of the liquid crystal display device;

a panel power maintaining section for supplying power to the liquid crystal display panel for a certain period when the power source OFF detecting section detects the OFF signal; and an erasing section for, when the power source OFF detecting section detects the OFF signal, lighting up the liquid crystal display panel entirely on a saturation voltage of liquid crystal using the power supplied by the panel cower maintaining section and subsequently shutting off the liquid crystal display panel entirely.

Examples of the OFF signal that turns OFF the power source of the main body of the liquid crystal display device, which is detected by the detecting section, include an input command from the user to turn OFF the power source of the main body of the liquid crystal display device and a secondary signal generated in the liquid crystal display device from the input command. The power source OFF detecting section may detect that the power source of the main body of the liquid crystal display device will go OFF by monitoring a power source voltage of the liquid crystal display device and obtaining a change in the power source voltage caused by the turning OFF of the power source.

Thus, the OFF signal that turns OFF the power source of the main body of the liquid crystal display device can be a signal based on a command to turn OFF the liquid crystal display device or a signal indicating the disconnection of the power source for some reason. Upon detection of the OFF signal, the power source OFF detecting section conveys the detection result to both the panel power maintaining section and erasing section. Accordingly, the panel power maintaining section supplies power to the liquid crystal display panel for a certain period, so that the liquid crystal display panel can keep displaying an image after the power source of the main body of the liquid crystal display device is turned OFF. Consequently, it has become possible to drive the liquid crystal display panel after the power source of the main body of the liquid crystal display device is turned OFF.

Also, when the power source OFF detecting section detects the OFF signal, the erasing section lights up the liquid crystal display panel entirely on the saturation voltage of the liquid crystal, and subsequently shuts off the liquid crystal display panel entirely using the power supplied from the panel power maintaining section.

Accordingly, even if a half-tone image is displayed on the liquid crystal display panel before the power source of the main body of the liquid crystal display device is turned OFF and an amount of the restoring energy of the liquid crystal is small because the distortion is minor, the saturation voltage is applied to the liquid crystal of the liquid crystal display panel to increase an amount of the restoring energy to a satisfactory level. Thus, when the liquid crystal display panel is shut off entirely after being lit up entirely, the liquid crystal is turned OFF quickly. In other words, an afterimage on the liquid crystal display panel can be erased quickly.

In this case, an afterimage can be erased faster if the liquid crystal display panel is arranged to apply a voltage which turns OFF the liquid crystal to the liquid crystal when lighting up and subsequently shutting off the liquid crystal display panel entirely.

As shown in FIGS. 32(*a*) and 32(*b*), for example, when the power source of the main body is turned OFF while the liquid crystal display panel was displaying an image at the level 6, it used to take 320 msec for the liquid crystal display panel to return to the display state of the level 8. However, if the saturation voltage is applied to the liquid crystal display panel to make the display state to the level 1 first like in the erasing device for a liquid crystal display image of the present invention, it takes only 70 msec to erase an afterimage.

If the TFTs (Thin Film Transistors) are used as the active elements, liquid crystal with high maintaining ability is required, and in general, liquid crystal with high specific resistance ($1\times10^{12}\Omega\cdot$cm) is used. It takes a long time for the liquid crystal with high specific resistance to discharge the charges, and it is more difficult to erase an afterimage. However, applying the saturation voltage before applying a voltage which turns OFF the liquid crystal in the above manner is very effective in such a case.

If an afterimage on the liquid crystal display panel is erased quickly, the charges withheld in the liquid crystal are discharged in a short time, thereby making it possible to suppress the deterioration of the liquid crystal due to an abnormal voltage.

For a fuller understanding of the nature and advantages of the invention, reference should be made to the ensuing detailed description taken in conjunction with the accompanying drawings.

BRIEF DESCRIPTION OF THE DRAWINGS

FIG. 15 is a view explaining a waveform of a signal outputted when the liquid crystal display device of FIG. 13 is switched OFF from ON;

FIG. 17 is a view explaining waveforms of signals outputted when a liquid crystal display device of the fifth embodiment of the present invention arranged in another manner is switched OFF from ON;

FIG. 18 is a view explaining waveforms of signals outputted when a liquid crystal display device of the fifth embodiment of the present invention arranged in still another manner is switched OFF from ON;

FIG. 26 is a view explaining signal waveforms of outputs from a major portion of the liquid crystal display device of FIG. 25 when being switched OFF from ON;

FIG. 28 is a view explaining signal waveforms of outputs from a major portion of the liquid crystal display device of FIG. 27 when being switched OFF from ON;

FIG. 32(*b*) is a graph showing a relation between the transmittance and the number of levels/applied voltage.

DESCRIPTION OF THE EMBODIMENT

First Embodiment

The following description will describe a first embodiment of the present invention.

Figure 1:
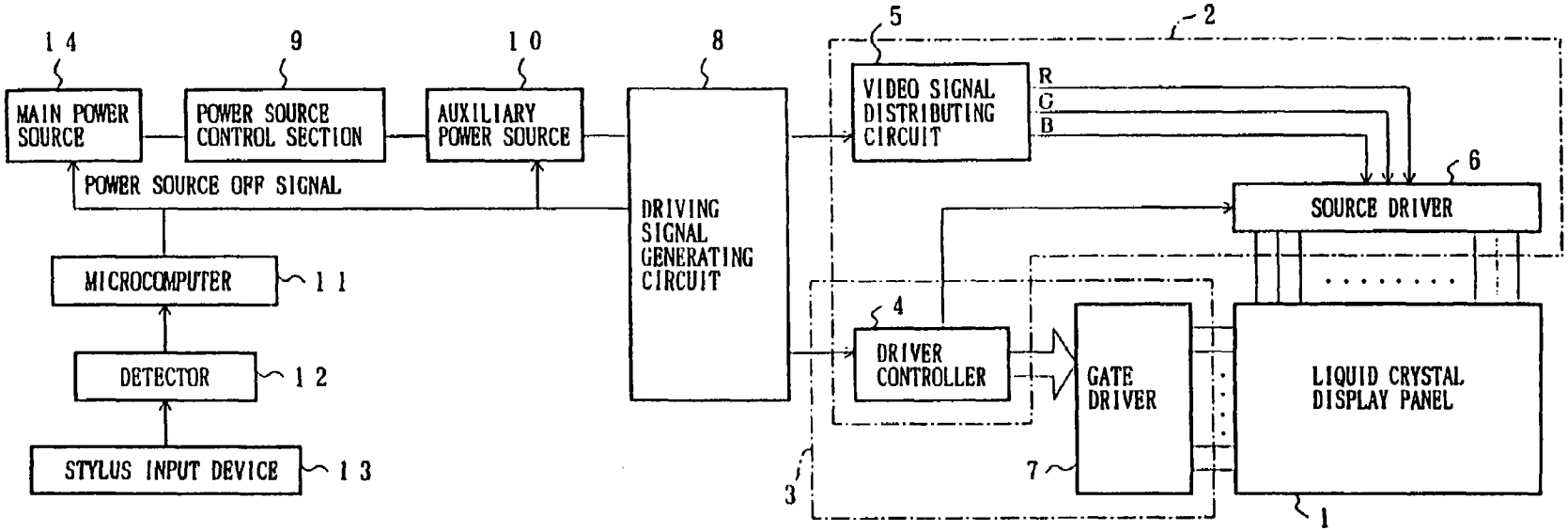
FIG. 1 is a block diagram depicting an arrangement of a liquid crystal display device in accordance with a first embodiment of the present invention.

FIG. 1 is a block diagram depicting an arrangement of a liquid crystal display device id accordance with the present embodiment (hereinafter, referred to as the present liquid crystal display device). As shown in the drawing, the present liquid crystal display device includes a liquid crystal display panel 1, a source driving section 2, a gate driving section 3, a driving signal generating circuit 8, a power source control section 9, an auxiliary power source 10, a microcomputer 11, a detector 12, a stylus input device 13, and a main power source 14.

Figure 2:
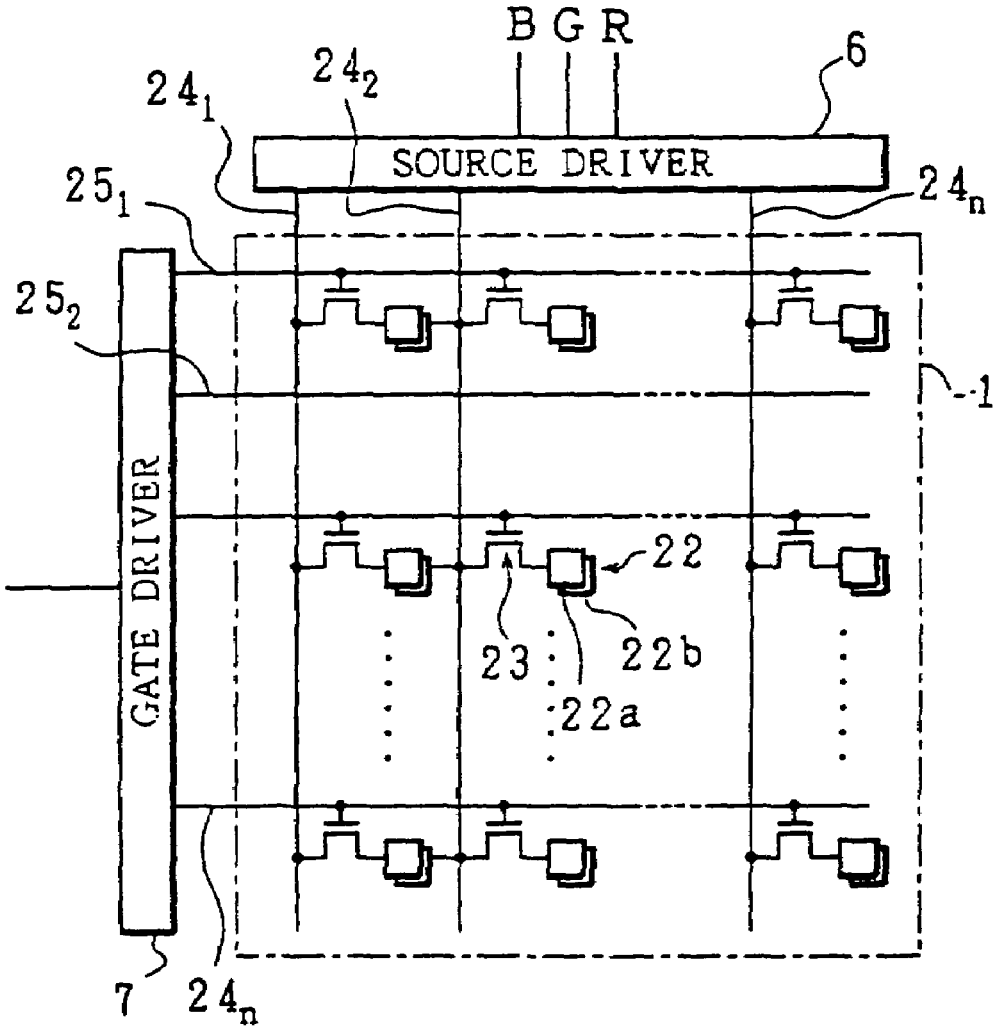
FIG. 2 is a view explaining an equivalent circuit of a liquid crystal panel of the liquid crystal display device of FIG. 1.

The liquid crystal display panel 1 comprises a pair of glass substrates laminated to each other, and GH (Guest-Host) liquid crystal sandwiched by the substrates. The liquid crystal display panel 1 further comprises a reflector, and serves as a reflective liquid crystal display panel which displays an image using incident light from the external. FIG. 2 is a view explaining an equivalent circuit of the liquid crystal display panel 1. As shown in the drawing, a plurality of pixels 22 made of liquid crystal are aligned in a matrix of m rows and n columns on the liquid crystal display panel 1. Each pixel 22 includes a display electrode 22*a* and an opposing electrode 22*b* opposing the display electrode 22*a*. The display electrode 22*a* is connected to the drain of a TFT 23 serving as an active element. The source and gate of each TFT 23 are respectively connected to source lines 24 and gate lines 25 which intersect at right angles.

A voltage applied to the liquid crystal forming each pixel 22 has a voltage value corresponding to a video signal which will be described below. An arbitrary voltage in a range between an ON-level (the saturation voltage of the liquid crystal) and an OFF-level (below the threshold voltage at which the liquid crystal goes OFF) is applied to the liquid crystal.

As shown in FIG. 1, the source driving section 2 comprises a video signal distributing circuit 5, a driver controller 4, and a source driver 6. The source driving section 2 receives a composite video signal made of multi-color video signals from the driving signal generating circuit 8 which will be described below. Then, the video signal distributing circuit 5 serving as video signal distributing means distributes the composite signal into RGB mono-color video signals, which are outputted concurrently to n source lines 24 ($\mathbf{24}_1$-$\mathbf{24}_n$) on the liquid crystal display panel 1 in sync with a horizontal synchronizing signal inputted into the source driver 6 from the driver controller 4 (see FIG. 2). In this manner, the mono-color video signals are outputted for every horizontal period to display the pixels 22 for one line on the liquid crystal display panel 1.

As shown in FIG. 1, the gate driving section 3 comprises the driver controller 4 and a gate driver 7. The gate driving section 3 drives m gate lines 25 ($25_1$-$25_m$) on the liquid crystal display panel 1 sequentially at a high level for one horizontal period, so that the TFTs 23 on the first through m'th lines are sequentially turned ON per line, whereby a gate driving signal is applied to the corresponding pixel 22.

The driver controller 4 is a circuit for generating horizontal and vertical synchronizing signals based on the composite video signal inputted from the driving signal generating circuit 8 which will be described below. The horizontal and vertical synchronizing signals are synchronizing signals to drive the source driver 6 and gate driver 7 in sync with each other. The driver controller 4 includes an unillustrated shift register and also serves as a circuit for generating the gate driving signal. The shift register in the driver controller 4 receives the vertical synchronizing signal at the data terminal in the first stage as a start signal, and upon input of the horizontal synchronizing signal at the clock terminal in each stage, the shift register outputs a pulse, which is in effect the start signal (vertical synchronizing signal) delayed sequentially by one horizontal period, to the gate driver 7 from the output terminal of each stage. The above description relates to a normal gate driving signal. The gate driver 7 converts the level of the input pulse, and outputs the resulting pulse to the gate lines $25_1$-$25_m$ on the liquid crystal display panel 1 (see FIG. 2).

The driving signal generating circuit 8 sends an arbitrary composite video signal stored in an unillustrated memory or the like to the video signal distributing circuit 5 and driver controller 4 in a normal operation. The driving signal generating circuit 8 is furnished with another function. More specifically, upon input of a power source OFF signal, which will be described below, the driving signal generating circuit 8 outputs a composite video signal which applies the saturation voltage of the liquid crystal to light up the liquid crystal display panel 1 entirely for at least one vertical period. Later, the driving signal generating circuit 8 outputs another composite video signal which shuts off the liquid crystal display panel 1 entirely. In other words, the driving signal generating circuit 8, driver controller 4, source driver 6, and gate driver 7 are furnished with a function to serve as erasing means of the present invention.

The source power control section 9 drives the liquid crystal display panel 1 by controlling the supply of the power from the main power source 14 of the main body of the present liquid crystal display device. In FIG. 1, a power supply bus line from the main power source 14 is connected to the driving signal generating circuit 8 alone. However, in practice, unillustrated bus lines are also connected to driving mechanism of the liquid crystal display panel 1, such as the source driving section 2 and gate driving section 3, to supply the power.

The microcomputer 11 is a control center for controlling each section of the main body of the present liquid crystal display device. Also, when the user inputs a command using the stylus input device 13, the detector 12 detects a command content based on a relation with respect to the coordinate position, and outputs the same to the microcomputer 11. Thus, if the user inputs a command to turn OFF the main power source 14 of the main body of the present liquid crystal display device through the stylus input device 13 and the detector 12 inputs the command content to the microcomputer 11, the microcomputer 11 outputs the power source OFF signal to the main power source 14, auxiliary power source 10, and driving signal generating circuit 8. In short, the microcomputer 11, detector 12, and stylus input device 13 constitute power source OFF detecting means, and the microcomputer 11 are also furnished with a function to serve as power source OFF signal generating means.

The auxiliary power source 10 is provided on the power supply bus line from the main power source 14 to the liquid crystal display panel 1, and furnished with a function to serve as panel power maintaining means. Upon input of the power source OFF signal from the microcomputer 11, the auxiliary power source 10 starts to supply an operation power to the driving signal generating circuit 8, source driving section 2, gate driving section 3, etc. to drive the liquid crystal display panel 1.

Figure 3:
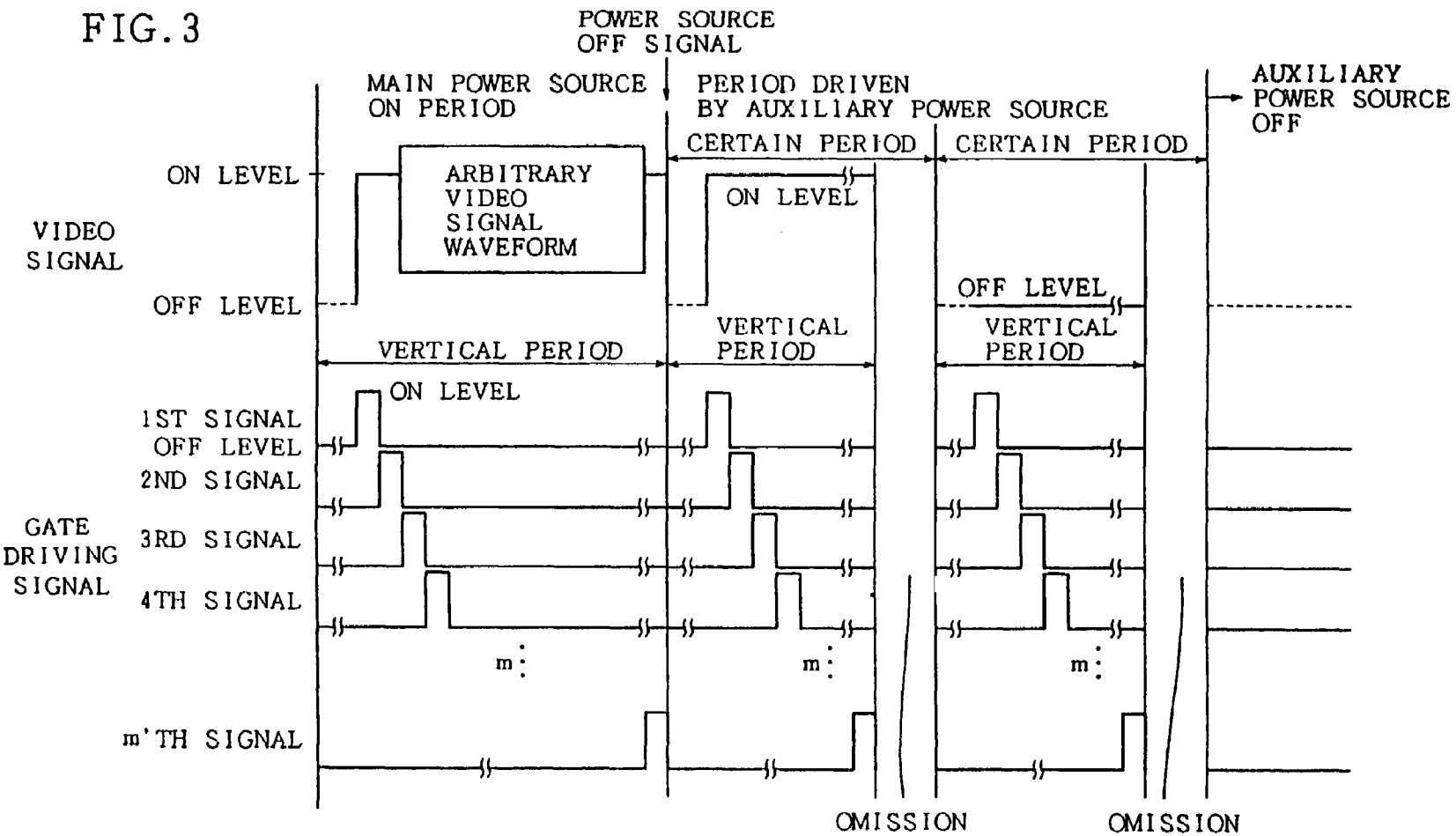
FIG. 3 is a view explaining waveforms of driving signals applied to the liquid crystal display panel when the main power source of the liquid crystal display device of FIG. 1 is turned OFF.

Next, an operation of the present liquid crystal display device arranged as above when the user inputs a command to turn OFF the main power source 14 will be explained with reference to FIG. 3. FIG. 3 is a view explaining waveforms of driving signals applied to the liquid crystal display panel 1 when the main power source 14 is turned OFF.

To begin with, when the user inputs a command to turn OFF the main power source 14 of the present liquid crystal display device through the stylus input device 13, the detector 12 detects the command content and notifies the microcomputer 11 of the same. Accordingly, the microcomputer 11 outputs a power source OFF signal directing to turn OFF the main power source 14 to the main power source 14, auxiliary power source 10, and driving signal generating circuit 8.

The main power source 14 goes off upon input of the power source OFF signal, whereupon the power supply to the liquid crystal display panel 1 through the power source control section 9 is shut off. On the other hand, the auxiliary power source 10 comes ON upon input of the power source OFF signal, and starts to supply the power for driving the liquid crystal display panel 1 for a certain period instead of the main power source 14.

Also, upon input of the power source OFF signal, the driving signal generating circuit 8 generates a composite video signal which lights up the liquid crystal display panel 1 entirely for a certain period not shorter than one vertical period on the saturation voltage of the liquid crystal, and outputs the same to the source driving section 2 and gate driving section 3. Here, the driving signal generating circuit 8 is driven on the power supply from the auxiliary power source 10. One vertical period referred herein means a period required for one vertical scan on the liquid crystal display panel 1.

As shown in FIG. 3, along with the operation of the driving signal generating circuit 8, the liquid crystal display panel 1 receives a gate driving signal that sequentially turns ON the gate lines $25_1$-$25_m$ formed thereon from the gate driving section 3, while receiving an ON-level waveform that is applied to the source lines $24_1$-$24_n$ formed thereon from the source driving section 2 in sync with the gate driving signal, whereby the liquid crystal display panel 1 is kept lit up entirely for at least one vertical period.

Further, the driving signal generating circuit 8 generates another composite video signal which shuts off the liquid crystal display panel 1 entirely for a certain period not shorter than one vertical period after the above certain light-up period has passed, and outputs the same to both the source driving section 2 and gate driving section 3. Thus, as shown in FIG. 3, the gate driving section 3 inputs the gate driving signal which sequentially turns ON the gate lines $25_1$-$25_m$ to the liquid crystal display panel 1, while the source driving section 2 applies an OFF-level waveform to the source lines $24_1$-$24_n$ in sync with the gate driving signal, whereby the liquid crystal display panel 1 is kept shut off for at least one vertical period.

Subsequently, the auxiliary power source 10 goes OFF, and the present liquid crystal display device including the liquid crystal display panel 1 stops to operate.

As has been explained, after the main power source 14 of the present liquid crystal display device is turned OFF, the liquid crystal panel 1 is lit up entirely on the saturation voltage of the liquid crystal and subsequently shut off entirely by the power supply from the auxiliary power source 10.

Thus, even if the restoring energy is small because a half-tone image has been displayed on the liquid crystal display panel 1 and the distortion of the liquid crystal is minor, or the restoring energy is smaller because the GH liquid crystal having a slow response rate is used under the above condition, the saturation voltage is applied to all the pixels 22 on the liquid crystal display panel 1 to increase the liquid crystal restoring energy to a satisfactory level when the power supply stops, thereby making it possible to erase the afterimage quickly by shutting off the liquid crystal display panel 1 entirely after the restoration. Also, since the charges withheld in the liquid crystal can be discharged in a short period, it has become possible to prevent deterioration of the liquid crystal due to an abnormal voltage.

Consequently, although the present liquid crystal display device is a reflective type, it can attain a far more improved display quality compared with the display quality attained by a conventional erasing method.

Second Embodiment

The following description will describe a second embodiment of the present invention. Hereinafter, like components are labeled with like reference numerals with respect to the first embodiment, and the description of these components is not repeated for the explanation's convenience.

Figure 4:
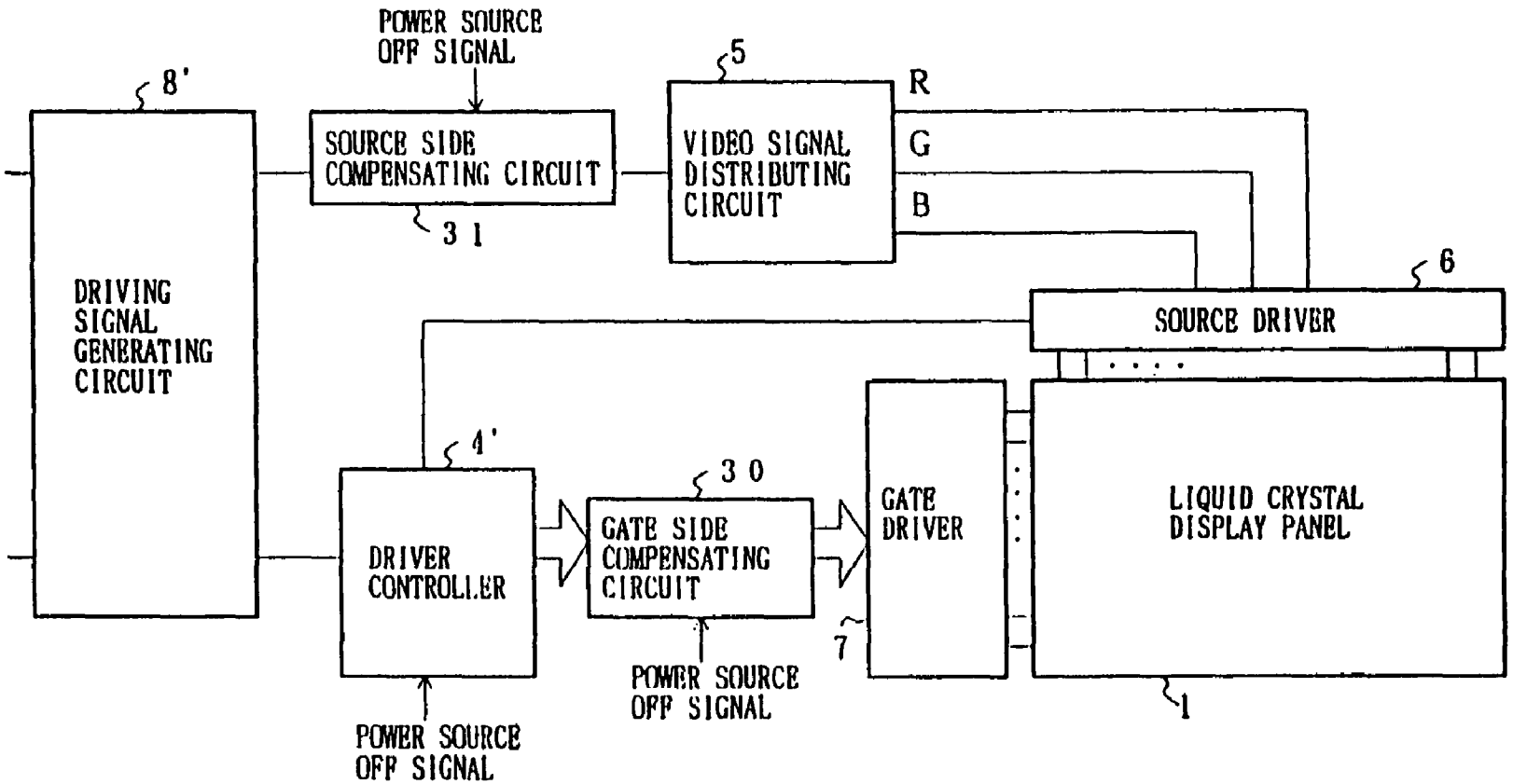
FIG. 4 is a block diagram depicting an arrangement of a liquid crystal display device in accordance with a second embodiment of the present invention.

FIG. 4 is a block diagram depicting an arrangement of a liquid crystal display device in accordance with the present embodiment (hereinafter, referred to as the present liquid crystal display device). As shown in the drawing, the present liquid crystal display device includes a source side compensating circuit 31 between a driving signal generating circuit 8' and the video signal distributing circuit 5, and a gate side compensating circuit 30 between a driver controller 4' and the gate driver 7.

The driving signal generating circuit 8' outputs an ON-level composite video signal which lights up the liquid crystal display panel 1 entirely on the saturation voltage of the liquid crystal, and an OFF-level composite video signal which shuts off the liquid crystal display panel 1 entirely through their respective unillustrated bus lines, and the source side compensating circuit 31 controls the switching between the two outputs for the input to the liquid crystal display panel 1 (herein, the input to the video signal distributing circuit 5).

Figure 5:
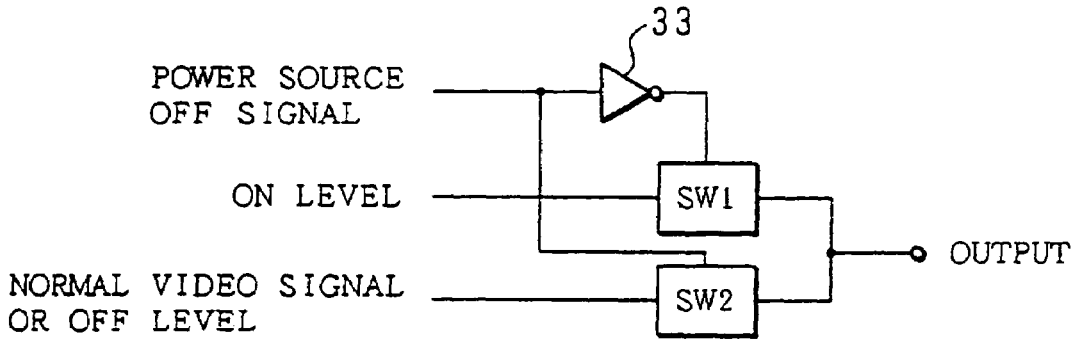
FIG. 5 is a view explaining a circuit diagram of a source side compensating circuit in the liquid crystal display device of FIG. 4.

FIG. 5 is a circuit diagram of the source side compensating circuit 31. The source side compensating circuit 31 receives the ON-level composite video signal generated by the driving signal generating circuit 8' at the input side of a switch SW1 when the main power source 14 of the present liquid crystal display device is turned OFF.

The source side compensating circuit 31 also receives an arbitrary video signal from the driving signal generating circuit 8' in a normal operation, and the OFF-level composite video signal at the input side of a switch SW2 when the main power source 14 is turned OFF.

The switches SW1 and SW2 come ON upon input of an L-level (Low-level) voltage signal as a switching control signal, and output the input composite video signal. In a normal operation, the L-level voltage signal is inputted to the switch SW2, while an H-level (High-level) voltage signal is inputted to the switch SW1 through an inverter 33 as the switching control signals. Thus, the source side compensating circuit 31 outputs the normal composite video signal.

When the user inputs a command to turn OFF the main power source 14, the microcomputer 11 outputs a pulse of the power source OFF signal to the source side compensating circuit 31 for a certain period. The power source OFF signal, which serves as the switching control signal with an H-level voltage, is inputted to the switch SW2, whereupon the switch SW2 goes OFF in pulse. At the same time, the L-level voltage signal is inputted to the switch SW1 as the switching control signal through the inverter 33, whereupon the switch SW1 comes ON in pulse. Consequently, the source side compensating circuit 31 outputs the ON-level composite video signal.

The microcomputer 11 outputs the pulse of the power source OFF signal for a period nearly as long as a blanking period, namely, a vertical retrace line period, during which the writing of a normal video signal shorter than one vertical period is inhibited. Accordingly, the source side compensating circuit 31 outputs the ON-level composite video signal which lights up the liquid crystal display panel 1 entirely on the saturation voltage of the liquid crystal.

On the other hand, the driver controller 4' outputs the normal gate driving signal that sequentially turns ON the m gate lines $\mathbf{25}_1$-$\mathbf{25}_m$ on the liquid crystal display panel 1 for every horizontal period, and another kind of gate driving signal that turns ON all the m gate lines $\mathbf{25}_1$-$\mathbf{25}_m$ within the blanking period through their respective unillustrated bus lines. The gate side compensating circuit 30 controls the switching of the gate driving signals of both kinds for the input to the liquid crystal display panel 1 (herein, the input to the gate driver 7).

Figure 6:
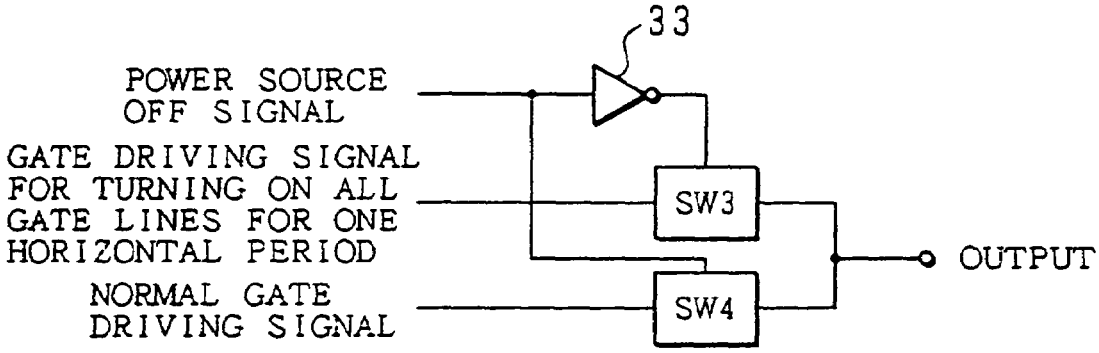
FIG. 6 is a view explaining a circuit diagram of a gate side compensating circuit in the liquid crystal display device of FIG. 4.

FIG. 6 is a view explaining a circuit diagram of the gate side compensating circuit 30. As shown in the drawing, the gate side compensating circuit 30 receives the gate driving signal which turns ON all the gate lines $\mathbf{25}_1$-$\mathbf{25}_m$ from the driver controller 4' at the input side of a switch SW3 when the main power source 14 is turned OFF. The gate side compensating circuit 30 also receives the normal gate driving signal at the input side of a switch SW4.

Like the switches SW1 and SW2 in the source side compensating circuit 31 described above, the switches SW3 and SW4 come ON upon input of the L-level voltage signal as the switching control signal. In a normal operation, the L-level voltage signal is inputted to the switch SW4, while the H-level voltage signal is inputted to the switch SW3 through the inverter 33 as the switching control signals. Thus, the gate side compensating circuit 30 outputs the normal gate driving signal.

When the user inputs a command to turn OFF the main power source 14, the microcomputer 11 outputs a pulse of the power source OFF signal to the gate side compensating circuit 30 for a certain period. The power source OFF signal, which serves as the switching control signal with an H-level voltage, is inputted to the switch SW4, whereupon the switch SW4 goes OFF in pulse. At the same time, the L-level voltage signal is inputted to the switch SW3 as the switching control signal through the inverter 33, whereupon the switch SW3 comes ON in pulse. Consequently, the gate side compensating circuit 30 outputs the gate driving signal which turns ON the gate lines on the liquid crystal display panel 1. Although it is not illustrated in FIG. 4, the gate side compensating circuit 30 is provided for each of the gate lines $\mathbf{25}_1$-$\mathbf{25}_m$, so that all the gate lines $\mathbf{25}_1$-$\mathbf{25}_m$ on the liquid crystal display panel 1 are turned ON concurrently by the gate side compensating circuits 30.

Figure 7:
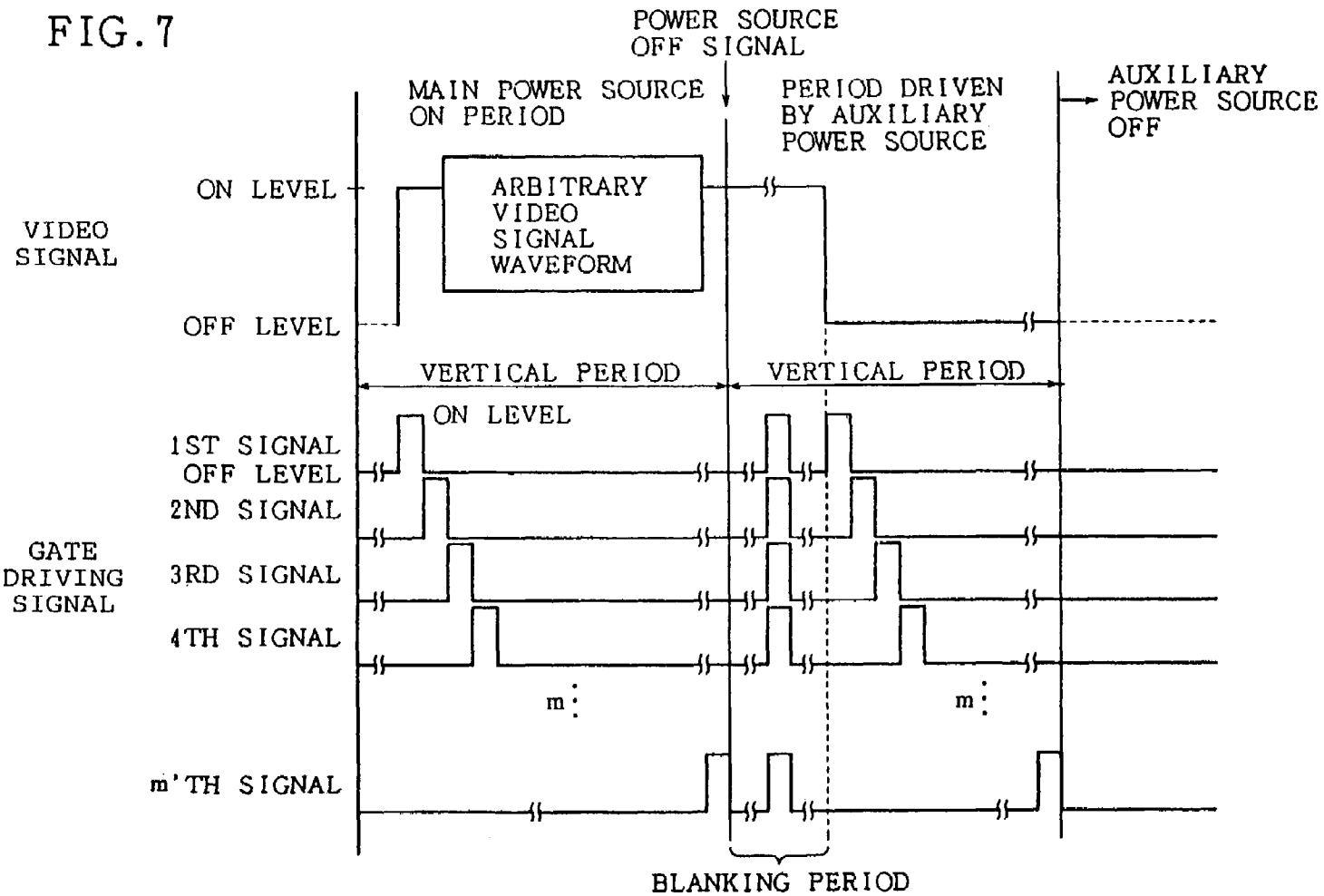
FIG. 7 is a view explaining waveforms of driving signals applied to a liquid crystal display panel when the main power source of the liquid crystal display device of FIG. 4 is turned OFF.

FIG. 7 shows waveforms of the driving signals applied to the liquid crystal panel 1 after a command to turn OFF the main power source 14 of the present liquid crystal display device arranged as above is issued. As shown in the drawing, upon issuance of the command to turn OFF the main cower source 14 of the present liquid crystal display device, the liquid crystal display panel 1 is lit up entirely during the blanking period within the vertical period. This makes it possible to light up and shut off the liquid crystal display panel 1 entirely within one vertical period, thereby erasing an afterimage faster than the counterpart in the first embodiment. Also, the deterioration of the liquid crystal due to the application of an abnormal voltage can be suppressed more effectively.

In the present liquid crystal display device, the driving signal generating circuit 8', source side compensating circuit 31, driver controller 4', gate side compensating circuit 30, source driver 6, and gate driver 7 constitute erasing means of the present invention having source side compensating means and gate side compensating means.

Figure 8:
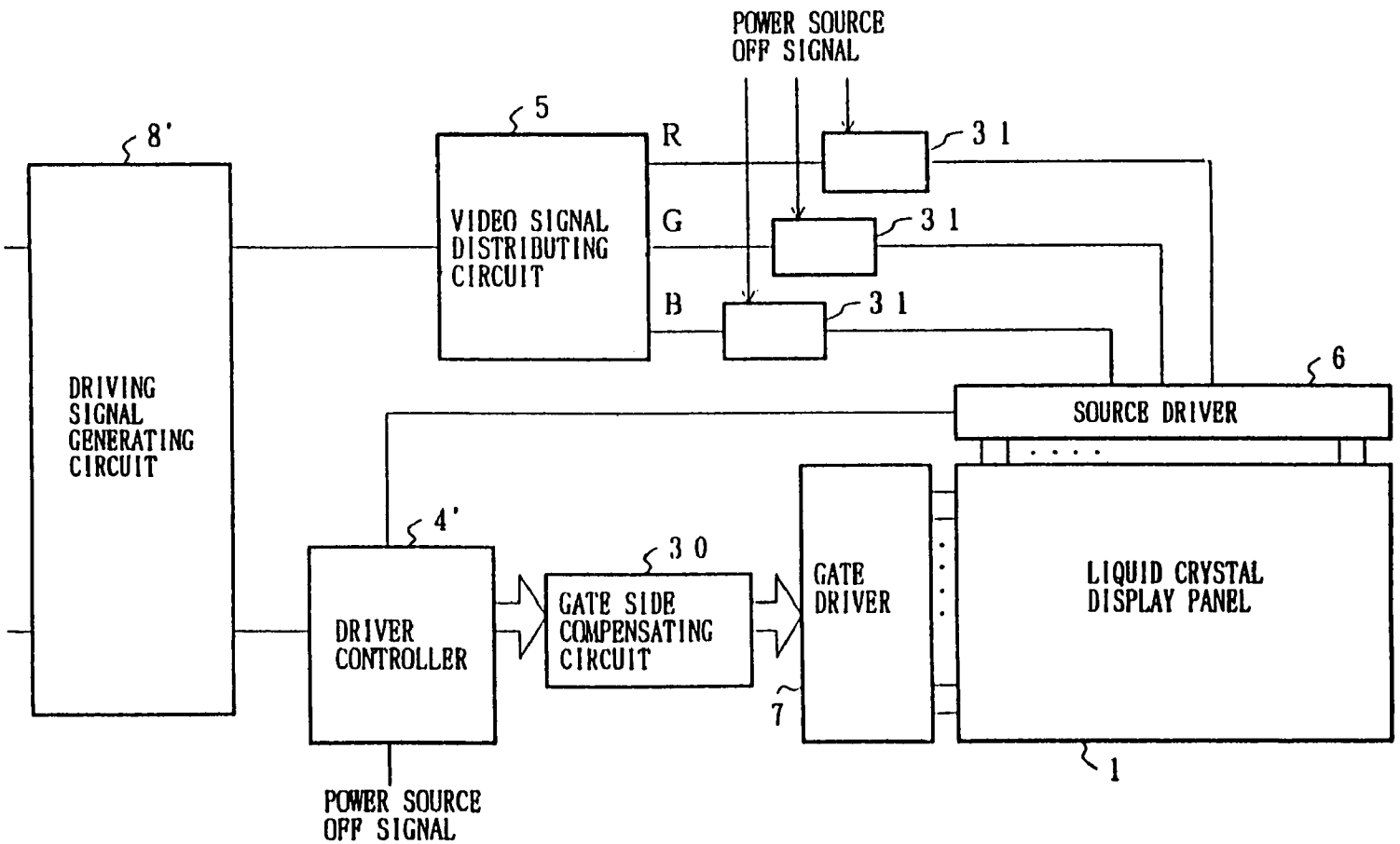
FIG. 8 is a block diagram depicting another arrangement of the liquid crystal display device in accordance with the second embodiment of the present invention.
Figure 9:
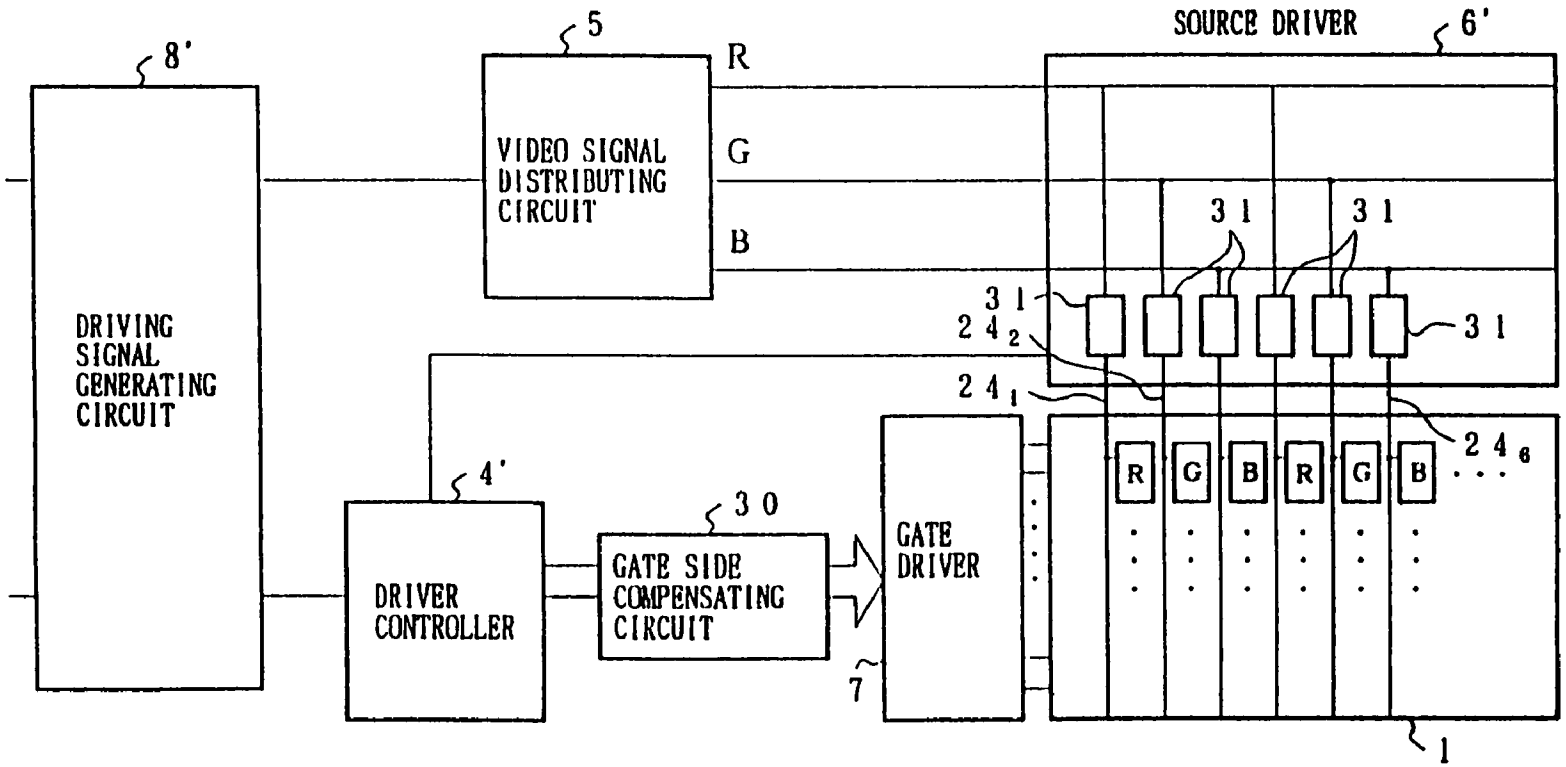
FIG. 9 is a block diagram depicting still another arrangement of the liquid crystal display device in accordance with the second embodiment of the present invention.

Incidentally, the present liquid crystal display device which lights up the liquid crystal display panel 1 entirely using the blanking period can be modified as shown FIGS. 8 and 9.

In a liquid crystal display device of FIG. 8, the source side compensating circuit 31 is provided at the output side of the video signal distributing circuit 5, that is, somewhere between the video signal distributing circuit 5 and source driver 6. When arranged in this manner, the composite video signal from the driving signal generating circuit 8' is inputted to the video signal distributing circuit 5 and distributed as mono-color RGB video signals before being inputted to the source side compensating circuit 31. Thus, the source side compensating circuit 31 must be provided to each of the RGB source lines.

In a liquid crystal display device of FIG. 9, the source side compensating circuit 31 is provided in the source driver 6' which receives a plurality of mono-color video signals for forming a color or monochrome image. Thus, as many source side compensating circuits 31 as the number of the source lines $\mathbf{24}_1$-$\mathbf{24}_n$ must be provided in this case.

Although the waveforms of the driving voltages for the liquid crystal display panel 1 of the liquid crystal display devices of FIGS. 8 and 9 are same as those shown in FIG. 7, the most preferred is the liquid crystal display panel of FIG. 4 because of the simple arrangement.

Third Embodiment

The following description will describe a third embodiment of the present invention, Hereinafter, like components are labeled with like reference numerals with respect to the above embodiments, and the description of these components is not repeated for the explanation's convenience.

Figure 10:
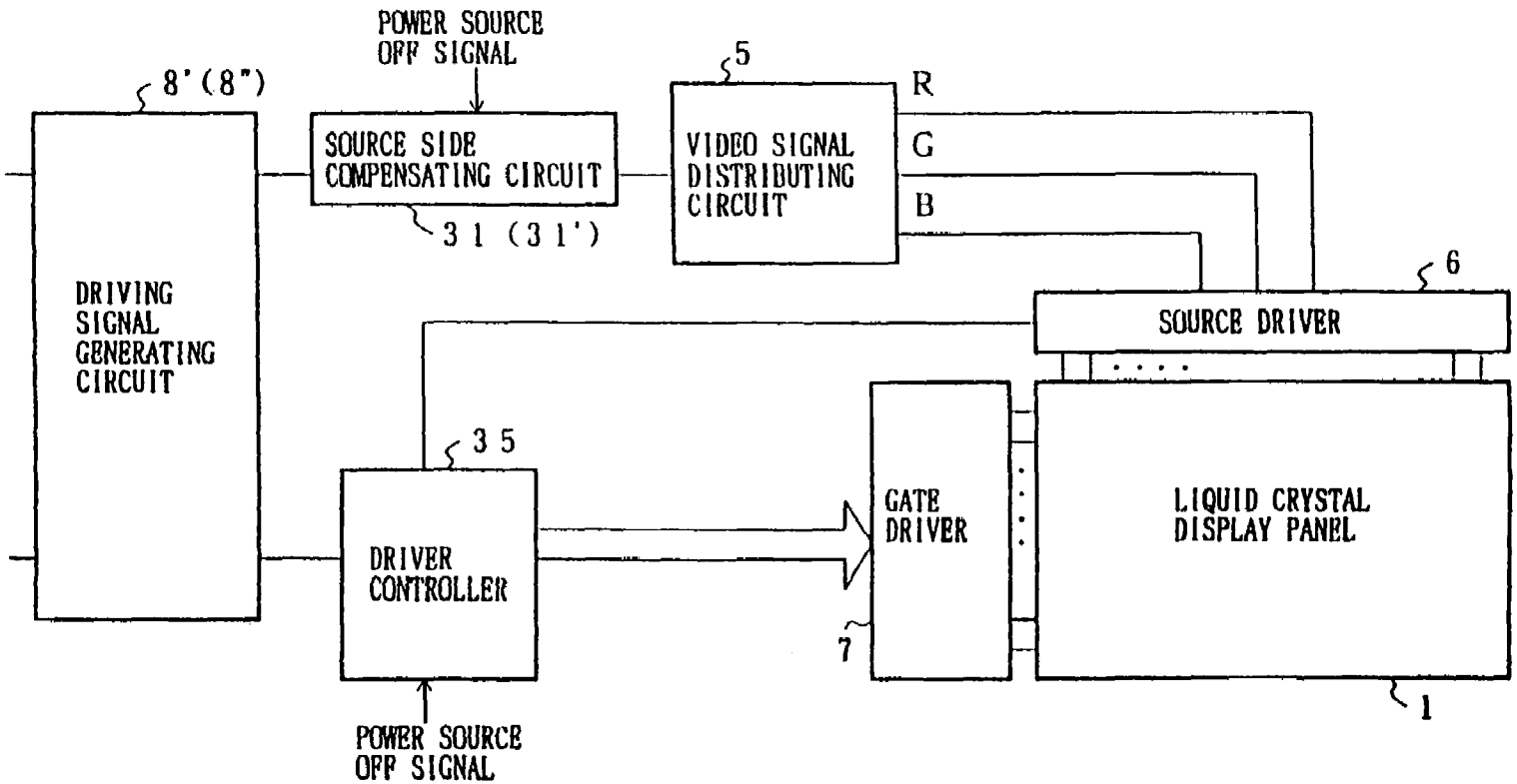
FIG. 10 is a block diagram depicting an arrangement of a liquid crystal display device in accordance with third and fourth embodiments of the present invention.

FIG. 10 is a block diagram depicting a liquid crystal display device in accordance with the present embodiment (hereinafter, referred to as the present liquid crystal display device). As shown in the drawing, the source side compensating circuit 31 is provided between the driving signal generating circuit 8' and video signal distributing circuit 5. Also, a driver controller 35 provided herein latches and withholds the vertical synchronizing signals, and upon input of the power source OFF signal, the driver controller 35 extends all the withheld vertical synchronizing signals concurrently for a certain period and outputs the resulting signals.

Figure 11:
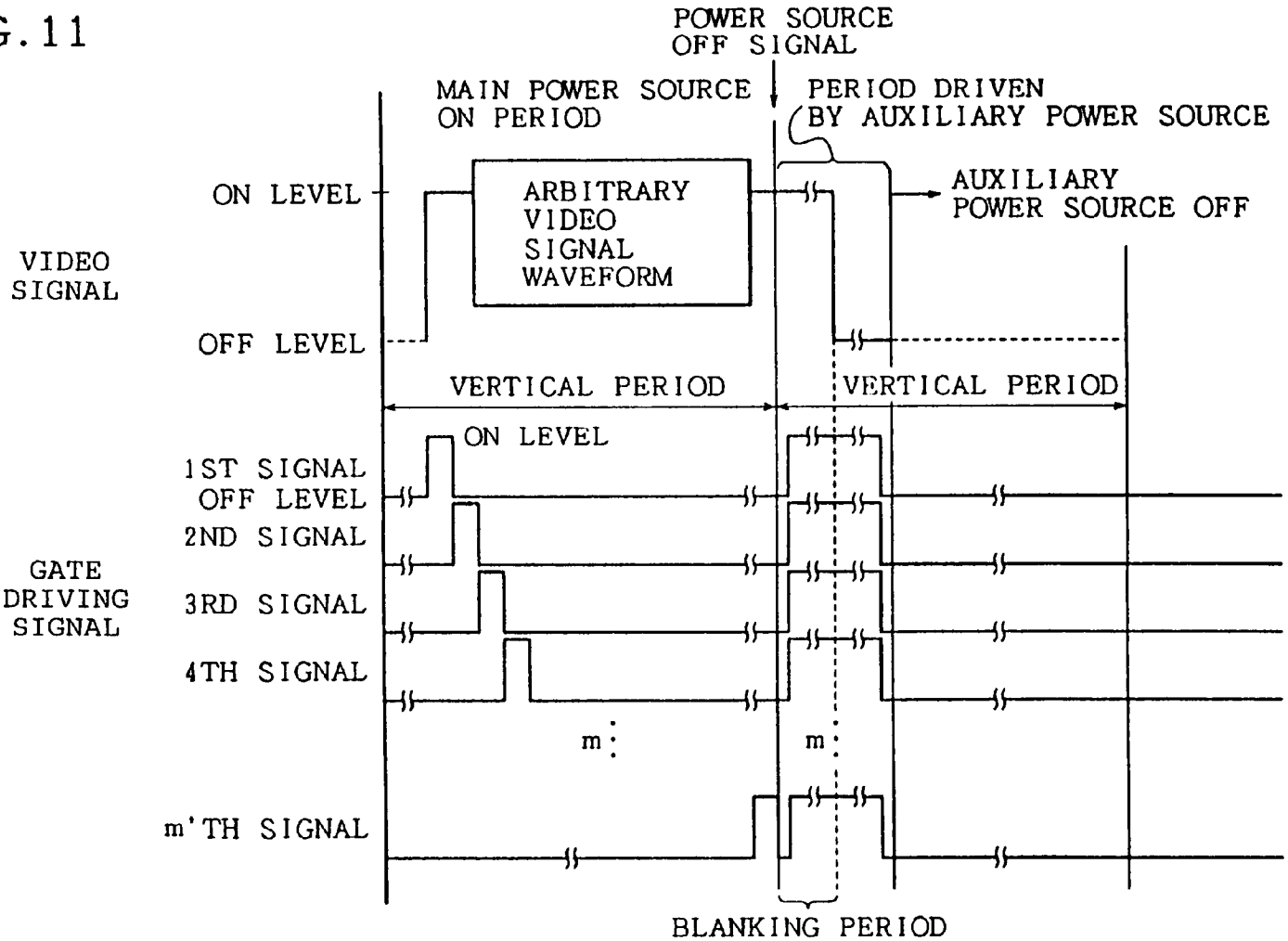
FIG. 11 is a view explaining waveforms of driving signals applied to a liquid crystal display panel when the main power source of the liquid crystal display device of the third embodiment is turned OFF.

In the present liquid crystal display device arranged as above, waveforms of the driving signals applied to the liquid crystal display panel 1 after a command to turn OFF the main power source 14 is issued is illustrated in FIG. 11. As shown in the drawing, the gate driving signal which stays ON over the blanking period within the vertical period is outputted to all the gate lines $\mathbf{25}_1$-$\mathbf{25}_m$ on the liquid crystal display panel concurrently. Thus, the present liquid crystal display device can erase an afterimage faster than the counterpart in the second embodiment, and accordingly, the deterioration of the liquid crystal due to the application of an abnormal voltage can be suppressed more effectively.

Fourth Embodiment

The following description will describe a fourth embodiment of the present invention. Hereinafter, like components are labeled with like reference numerals with respect to the above embodiments, and the description of these components is not repeated for the explanation's convenience.

As shown in FIG. 10, a liquid crystal display device in accordance with the present embodiment (hereinafter, referred to as the present liquid crystal display device) includes a source side compensating circuit 31' between a driving signal generating circuit 8" and the video signal distributing circuit 5. Also, the driver controller 35 of the present liquid crystal display device latches and withholds vertical synchronizing signals, and upon input of the power source OFF signal, extends all the withheld vertical synchronizing signals for a predetermined period and outputs the resulting signals.

The driving signal generating circuit 8" outputs a composite video signal that shifts from ON-level at which the liquid crystal display panel 1 is lit up entirely on the saturation voltage of the liquid crystal to OFF-level at which the liquid crystal display panel 1 is shut off entirely in a blanking period within one vertical period. The source side compensating circuit 31' controls the switching between the outputs of both kinds, namely, the composite video signal having both ON- and OFF-levels and the normal video signal, for the input to the liquid crystal display device 1 (herein, the input is the video signal distributing circuit 5).

Thus, although the source side compensating circuit 31' is arranged in the same manner as its counterpart of FIG. 5, the source side compensating circuit 31' receives the composite video signal having both ON- and OFF-levels at the switch SW1 and the normal composite video signal at the switch SW2.

Figure 12:
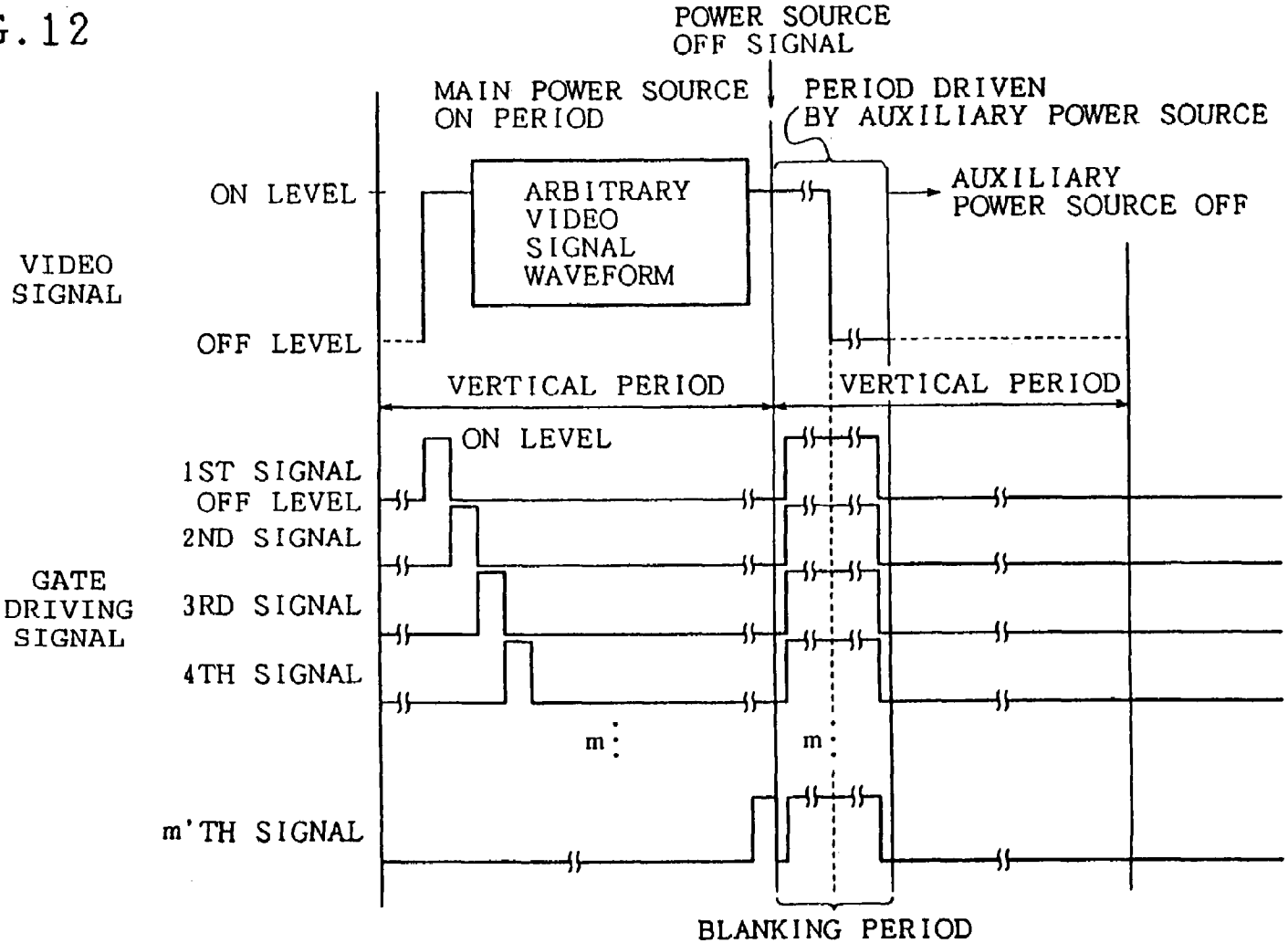
FIG. 12 is a view explaining waveforms of driving signals applied to a liquid crystal display panel when the main power source of the liquid crystal display device of the third embodiment is turned OFF.

FIG. 12 is a view explaining waveforms of the driving signals applied to the liquid crystal display panel 1 when a command to turn OFF the main power source 14 of the present liquid crystal display device is issued. As shown in the drawing, in the present liquid crystal display device, the gate driving signal is outputted to all the gate lines $\mathbf{25}_1$-$\mathbf{25}_m$ or the liquid crystal display panel 1 concurrently in the blanking period within the vertical period, during which the video signal is turned ON and OFF successively. For example, during a period from when the gate driving signal rises up until the auxiliary power source goes OFF, an ON-level composite video signal and an OFF-level composite video signal are sequentially inputted into the liquid crystal display panel 1. Consequently, the present liquid crystal display device can erase an afterimage faster than the counterpart in the third embodiment, and accordingly, the deterioration of the liquid crystal due to the application of an abnormal voltage can be suppressed more effectively.

In the above embodiments, the microcomputer 11 is used to output the power source OFF signal to turn OFF the main power source 14, and a function to detect whether the main power source 14 is turned OFF or not is provided to the microcomputer 11 instead of separately providing power source OFF detecting means. However, in case that the microcomputer 11 is omitted, the same can be done in the following manner.

That is, the power source control section 9 can be arranged in such a manner to observe the output voltage from the main power source 14 and detect whether the main power source 14 is turned OFF or not based on a voltage drop, so that the power source control section 9 outputs a video signal by means of the driving signal generating circuit 8 (8' or 8") when the main power source 14 is turned OFF. In this case, the power source control section 9 is arranged to output the power source OFF signal to the driving signal generating circuit 8 (8' or 8") and auxiliary power source 10 when the voltage drops below a certain level to notify that the main power source 14 is turned OFF. In short, the power source control section 9 serves as a voltage detector and also as power source OFF signal generating means. Here, to prevent the malfunction of the power source control section 9 when the output voltage starts to drop and rise repetitively, the power source control section 9 is preferably arranged to output a signal notifying that the main power source 14 is turned OFF to the driving signal generating circuit 8 (8' or 8") after awhile since the voltage has started to vary.

In the above embodiments, the auxiliary power source 10 is used as panel power maintaining means; however, the panel power maintaining means is not limited to the same. Alternatively, delaying means composed of a delaying circuit or the like may be provided to delay the turning OFF of the main power source 14 by controlling the delaying circuit or the like by the power source OFF signal from the microcomputer 11 or a signal form the above detector. In this case, an afterimage on the liquid crystal display panel 1 is erased using the power from the main power source 14 instead of the power from the auxiliary power source 10. Also, the turning OFF is delayed within the period during which the afterimage on the liquid crystal display panel is erased.

The auxiliary power source 10 may be arranged to generate energy, for example, by receiving external light, or accumulate supplied power from the main power source 14 using a capacitor or the like.

Also, the stylus input device 13 is not necessarily used to input a command to turn OFF the main power source 14, and the same can be done by simply turning ON/OFF a power source switch provided to the main body of the liquid crystal display device.

Fifth Embodiment

The following description will describe a fifth embodiment of the present invention. Hereinafter, like components are labeled with like reference numerals with respect to the above embodiments, and the description of these components is not repeated for the explanation's convenience.

Figure 13:
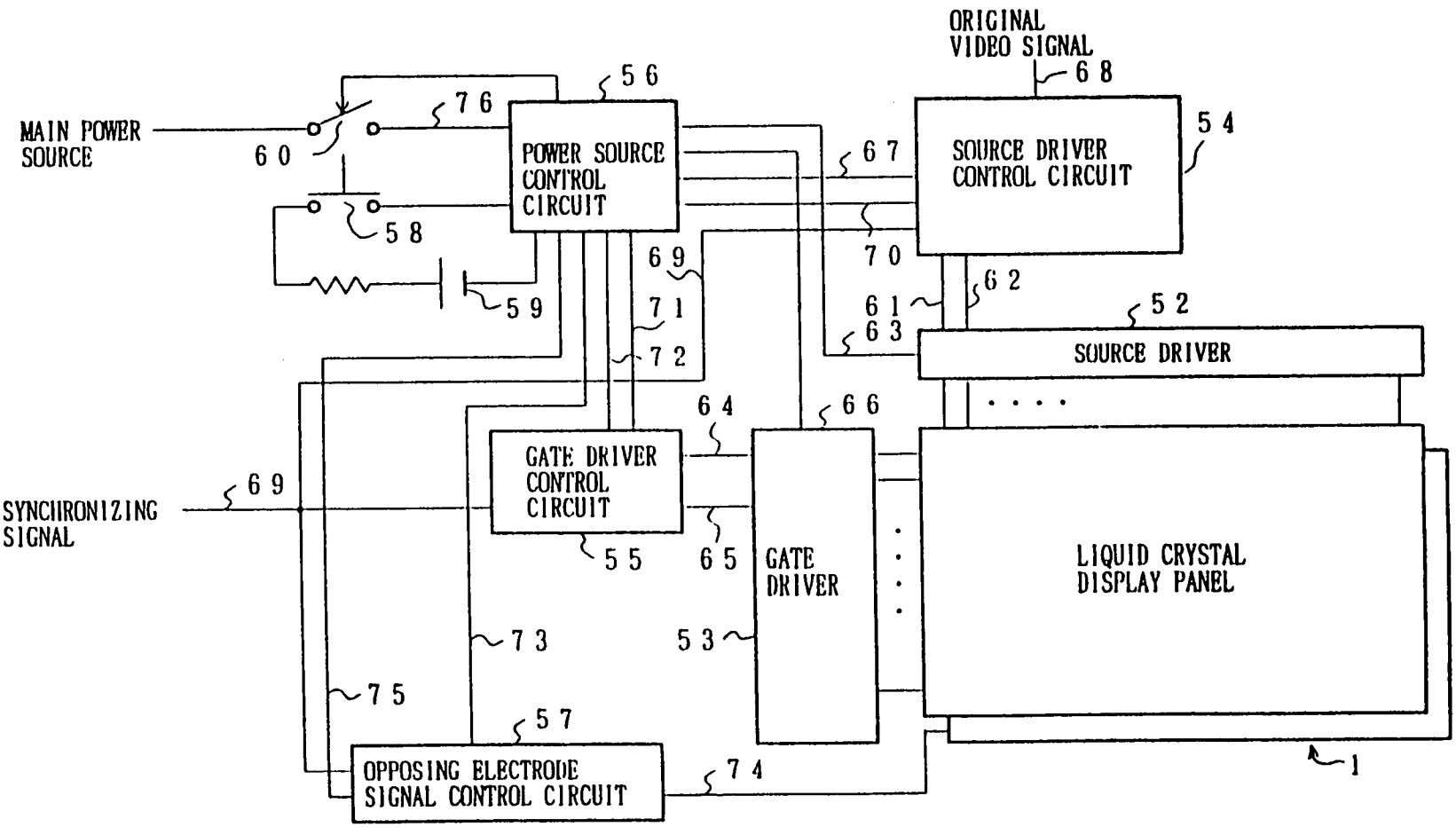
FIG. 13 is a block diagram depicting an arrangement of a liquid crystal display device in accordance with a fifth embodiment of the present invention.

FIG. 13 is a block diagram depicting an arrangement of a liquid crystal display device in accordance with the present embodiment (hereinafter, referred to as the present liquid crystal display device). As shown in the drawing, the present liquid crystal display device comprises the liquid crystal display panel 1, a source driver 52, a gate driver 53, a source driver control circuit 54, a gate driver control circuit 55, a power source control circuit 56, an opposing electrode signal control circuit 57, a judging switch 58, a judging power source 59, and a relay switch 60.

The source driver 52 receives control signals and video signals both outputted from the source driver control circuit 54 through a source control signal line 61 and a video signal line 62, respectively, and a detail of which will be given below. Also, the source driver 52 receives a driving power source voltage from the power source control circuit 56 through a source power source line 63, a detail of which will also be given below. The source driver 52 outputs the input video signals to all the n source lines $\mathbf{24}_1$-$\mathbf{24}_n$ on the liquid crystal display panel 1 in sync with the horizontal synchronizing signals of the control signals (see FIG. 2). Accordingly, the source driver 52 outputs a data signal to display the pixels 22 for one line on the liquid crystal display panel 1 for every horizontal period.

Here, the explanation is given or a case using a color video signal. However, the arrangement except for the video signal line is substantially the same in case of a monochrome liquid crystal display panel, and the explanation of which is omitted herein.

As previously mentioned, the source driver control circuit 54 controls the source driver 52, and a power source voltage supplied from the power source control circuit 56, which will be described below, is inputted to the same through a power source voltage line 67. Also, an original video signal and a synchronizing signal are inputted to the source driver control circuit 54 through an original video signal line 63 and a synchronizing signal line 69, respectively. The source driver control circuit 54 generates a video signal and a control signal as desired based on the input original video signal and synchronizing signal, respectively, which are supplied to the source driver 52 through the source control signal line 61 and video signal line 62, respectively.

Besides the aforementioned signal lines 61, 62, 67, 68, and 69, a source enable signal line 70 is connected to the source driver control circuit 54, so as to convey a source enable signal for judging whether an erasing action command outputted from the power source control circuit 56 should be carried out or not. While the source enable signal sways at H-level, the source driver control circuit 54 outputs a rectangular wave signal, which is in phase with an opposing electrode signal at the same voltage level and whose detailed explanation will be given below, to the source driver 52 instead of the normal video signal.

The gate driver 53 receives the control signals from the gate driver control circuit 55 through a gate control signal line 64, and a detailed explanation of the circuit 55 will be given below. Also, the gate driver 53 receives a driving power source voltage from the power source control circuit 56 through a gate power source line 66. Then, the gate driver 53 outputs the normal gate driving signal through the m gate lines $\mathbf{25}_1$-$\mathbf{25}_m$ on the liquid crystal display panel 1 based on the input control signals through the gate control signal line 64, and sequentially turns ON the TFTs 23 on the first through m'th lines per line for every horizontal period, whereby the gate driving signal is applied to the corresponding pixel 22.

Also, an enable pulse, which will be descried below, is supplied to the gate driver 53 from the gate driver control circuit 55 through an enable pulse signal line 65. Upon input of the enable pulse, the gate driver 53 outputs the enable pulse directly instead of the normal gate driving signal to turn ON all the TFTs 23 on the m gate lines $\mathbf{25}_1$-$\mathbf{25}_m$ on the liquid crystal display panel 1 concurrently.

As previously mentioned, the gate driver control circuit 55 controls the gate driver 53. A power source voltage supplied from the power control circuit 56, which will be described below, is supplied to the gate driver control circuit 55 through a power source voltage line 71. Also, a synchronizing signal is inputted to the same through the synchronizing signal line 69. Thus, the gate driver control circuit 55 generates a desired control signal based on the synchronizing signal, which is supplied to the gate driver 53 through the gate control signal line 64.

Besides the aforementioned signal lines 64, 69, and 71, a gate enable signal line 72 and an enable pulse signal line 65 are connected to the gate driver control circuit 55. The gate enable signal line 72 conveys a gate enable signal for judging whether an erasing action command outputted from the power source control circuit 56 should be carried out or not. Upon input of the H-level gate enable signal, the gate driver control circuit 55 outputs an enable pulse with a predetermined width to the gate driver 53 through the enable pulse signal 65.

The opposing electrode signal control circuit 57 controls the opposing electrode signal to be applied to the opposing electrode 22*b* in the liquid crystal display panel 1 through an opposing electrode signal line 74 based on the synchronizing signal inputted through the synchronizing signal line 69 and the power source voltage inputted through a power source line 73.

Also, an opposing enable signal line 75 is connected to the opposing electrode signal control circuit 57 to input an opposing enable signal for judging whether an erasing action command outputted from the power source control circuit 56 should be carried out or not. While the opposing enable signal stays at H-level, the opposing electrode signal control circuit 57 outputs a rectangular wave signal, which is in phase with the rectangular wave signal outputted from the source driver control circuit 54 at the same voltage level, as an opposing electrode signal.

The judging switch 58 serves as a mail switch of the main body of the present liquid crystal display device. Each time the judging switch 58 is pressed, the main body of the present liquid crystal display device is switched ON/OFF. The judging switch 58 outputs an ON/OFF judging signal to the power source control circuit 56. The ON/OFF judging signal stays at H-level having a predetermined voltage level while the judging switch 58 is being pressed, and is outputted as a judging signal pulse (judging pulse). While the judging switch 58 is not pressed, the voltage level of the ON/OFF judging signal is 0 volt.

The judging power source 59 is a power source that generates the judging signal pulse of the ON/OFF judging signal outputted while the judging switch 58 is being pressed. Since the judging power source 59 consumes quite a small amount of power, it can be composed of, for example, a button cell or a dry cell.

The power source control circuit 56 includes the aforementioned lines 61, 66, 67, 71, and 73 for supplying the power source voltage for driving the aforementioned control circuits 54, 53, and 57 and driving circuits 52 and 53. Also, the power source control circuit 56 includes a main power source line 76 for receiving a main power source for driving the main body of the present liquid crystal display device through the relay switch 60 in addition to the aforementioned enable signals 70, 72, and 75.

Further, the power source control circuit 56 is connected to both the judging switch 58 and judging power source 59. As will be described below, the power source control circuit 56 detects whether the main body of the present liquid crystal display device is turned ON/OFF, and opens/closes the relay switch 60 by shifting the level of a relay switch control signal. Further, when the power source is turned OFF, the power source control circuit 56 keeps supplying the power for driving the liquid crystal display panel 1 through the power source lines 61, 66, 67, 71, and 73 for a certain period before it turns OFF the relay switch 60, while at the same time outputting the enable signals through their respective enable signal lines 70, 72, and 75.

In the above arrangement, the power source control circuit 56, judging switch 58, and judging power source 59 constitute power source OFF detecting means, and the power source control circuit 56 is also furnished with a function to serve as a cower source managing circuit. The judging switch 58 and judging power source 59 constitute a power source OFF detecting circuit. In addition, the power source control circuit 56 also serves as power maintaining means. Further, the power source control circuit 56, source driver control circuit 54, source driver 52, and gate driver control circuit 55, gate driver 53, and opposing electrode signal control circuit 57 constitute erasing means.

Figure 14:
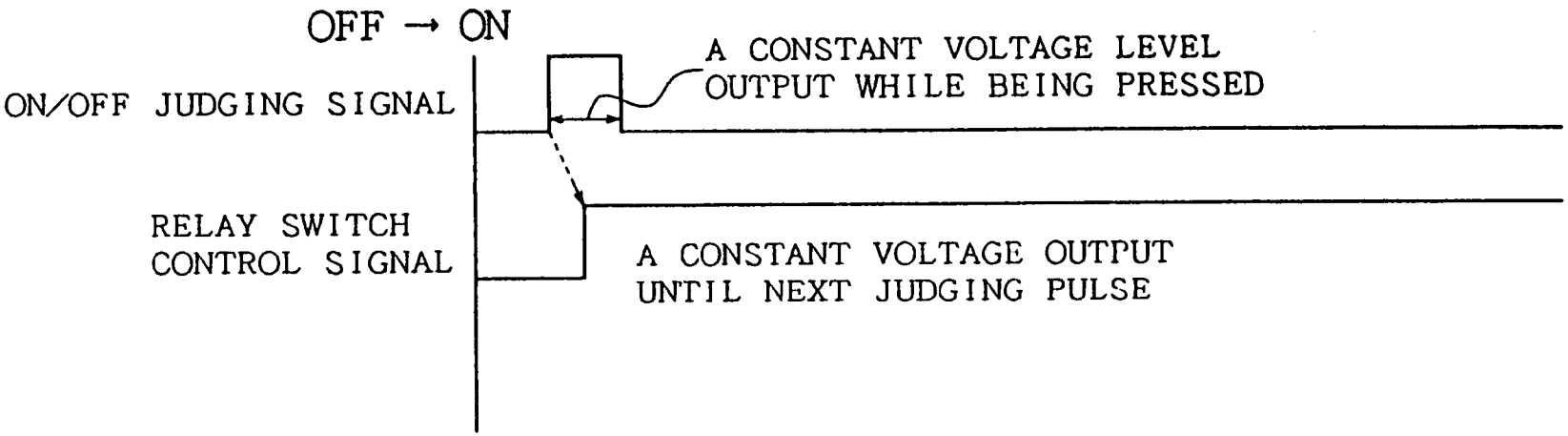
FIG. 14 is a view explaining waveforms of an ON/OFF judging signal and a relay switch control signal outputted when the liquid crystal display device of FIG. 13 is switched ON from OFF.
Figure 15:
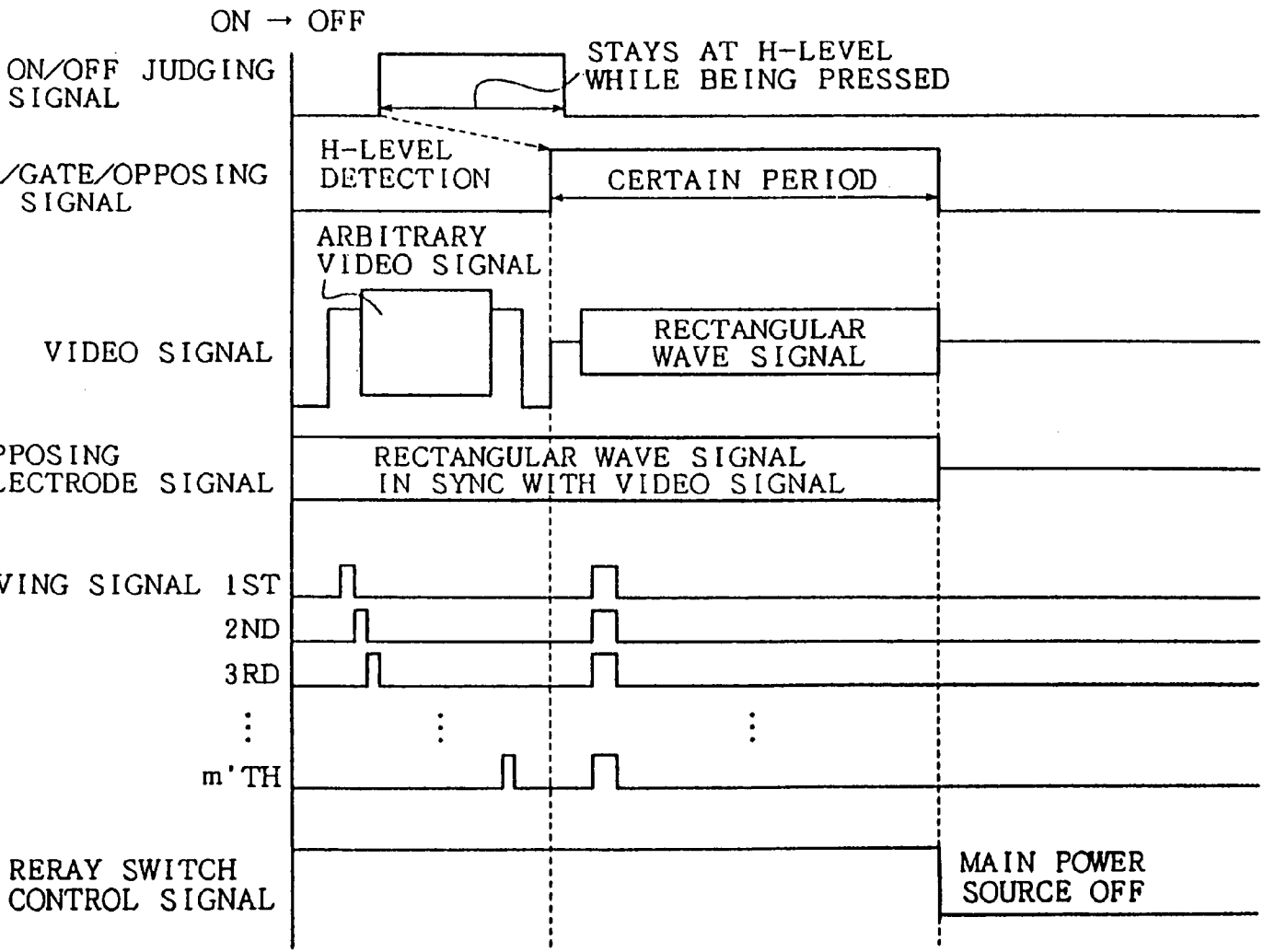
Figure 16:
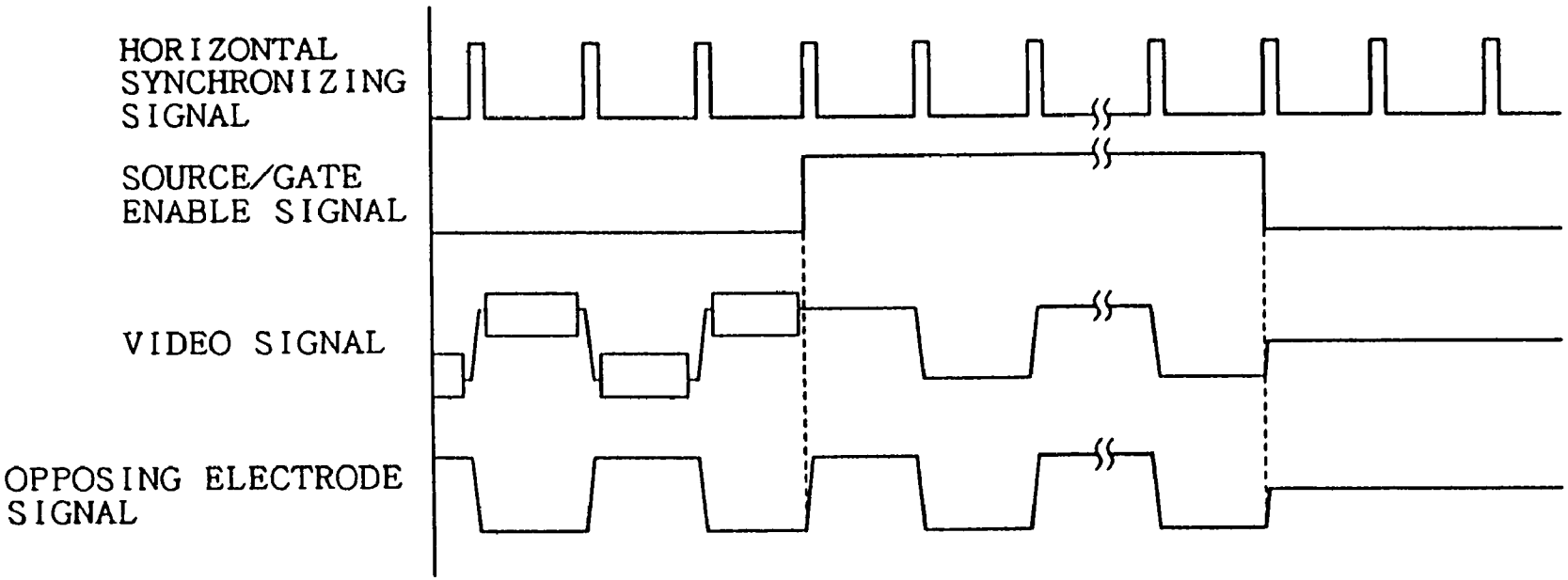
FIG. 16 is a view explaining a video signal and an opposing electrode signal of FIG. 15 in detail.

Next, an operation of the present liquid crystal display device arranged as above when the user inputs a command to turn ON/OFF the present liquid crystal display device by pressing the judging switch 58 will be explained with reference to waveforms of FIGS. 14 through 16. FIG. 14 shows waveforms of the ON/OFF judging signal and relay switch control signal both outputted when the present liquid crystal display device is switched ON from OFF. FIG. 15 is waveforms of signals outputted when the present liquid crystal display device is switched OFF from ON. FIG. 16 is an enlarged view of the video signal and opposing electrode signal of FIG. 15.

To begin with, the operation of the present liquid crystal display device when being switched ON from OFF will be explained.

When the judging switch 58 is pressed once while the main body of the present liquid crystal display device stays OFF, a judging signal pulse is shaped on the ON/OFF judging signal as shown in FIG. 14 while the judging switch 58 is being pressed. Upon detection of the judging signal pulse, the power source control circuit 56 shifts the relay switch control signal to H-level. The relay switch 60 conducts a current while the relay switch control signal stays at H-level, whereby a voltage is supplied to the power source control circuit 56 from the main power source. The power source control circuit 56 supplies desired signals to each circuit, so that the main body of the present liquid crystal display device comes ON. The relay switch control signal stays at H-level and keeps conducting a current through the relay switch 60 until the judging switch 58 is pressed again and another judging signal pulse is inputted.

Subsequently, the operation of the present liquid crystal display device when being switched OFF from ON will be explained.

When the judging switch 58 is pressed once while the main body of the present liquid crystal display device stays ON, the judging signal pulse is outputted as the ON/OFF judging signal as shown in FIG. 15. Upon detection of the judging signal pulse, the power supply control circuit 56 shifts the source enable signal, gate enable signal, and opposing enable signal to H-level for a certain period through their respective enable signals 70, 72, and 75 to erase an image.

Since an image is displayed normally until each enable signal has shifted to H-level, the source driver control circuit 54 keeps outputting arbitrary video signal and control signal to the source driver 52. The gate driver control circuit 55 outputs a normal control signal that sequentially turns ON a gate lines, while the opposing electrode signal control circuit 57 outputs an opposing electrode signal that matches with the arbitrary video signal.

When each enable signal has shifted to H-level, the gate driver control circuit 55 generates an enable pulse based on the H-level gate enable signal and outputs the same to the gate driver 53, which outputs the enable pulse directly to all the m gate lines $\mathbf{25}_1$-$\mathbf{25}_m$ on the liquid crystal display panel 1 concurrently as the gate driving signal.

At the same time, the source driver control circuit 54 outputs a rectangular wave signal as shown in FIG. 16, which is in phase with the opposing electrode signal at the same voltage level, to the source driver 52 instead of the normal video signal while the source enable signal stays at H-level. The source driver 52 outputs the supplied rectangular wave signal to all the n source lines $\mathbf{24}_1$-$\mathbf{24}_n$ on the liquid crystal display panel 1 concurrently in sync with the horizontal synchronizing signal in the normal manner.

The opposing electrode signal control circuit 57 outputs the rectangular wave signal, which is in phase with the rectangle wave signal of FIG. 15 outputted from the source driver control circuit 54 at the same voltage level, as the opposing electrode signal while the opposing enable signal stays at H-level.

Accordingly, a voltage applied to the pixels 22 is reduced to relatively zero volt, and the liquid crystal in each pixel 22 loses an applied voltage concurrently and the liquid crystal display panel 1 is shut off entirely, thereby erasing an afterimage in the liquid crystal. In an arrangement in which all the TFTs 23 on the gate lines $\mathbf{25}_1$-$\mathbf{25}_m$ are turned ON concurrently to shut off the liquid crystal display panel 1 entirely, a time required for the erasing action can be reduced to half the horizontal period at the maximum, thereby making it possible to erase an afterimage in a very short time.

After the liquid crystal in each pixel 22 is fully stabilized, the power source control circuit 56 shifts each enable signal to L-level (0 level), and shifts the relay switch control signal to L-level (0 level) to make the relay switch 60 nonconductive, whereby the power supply from the main power source is stopped.

Figure 17:
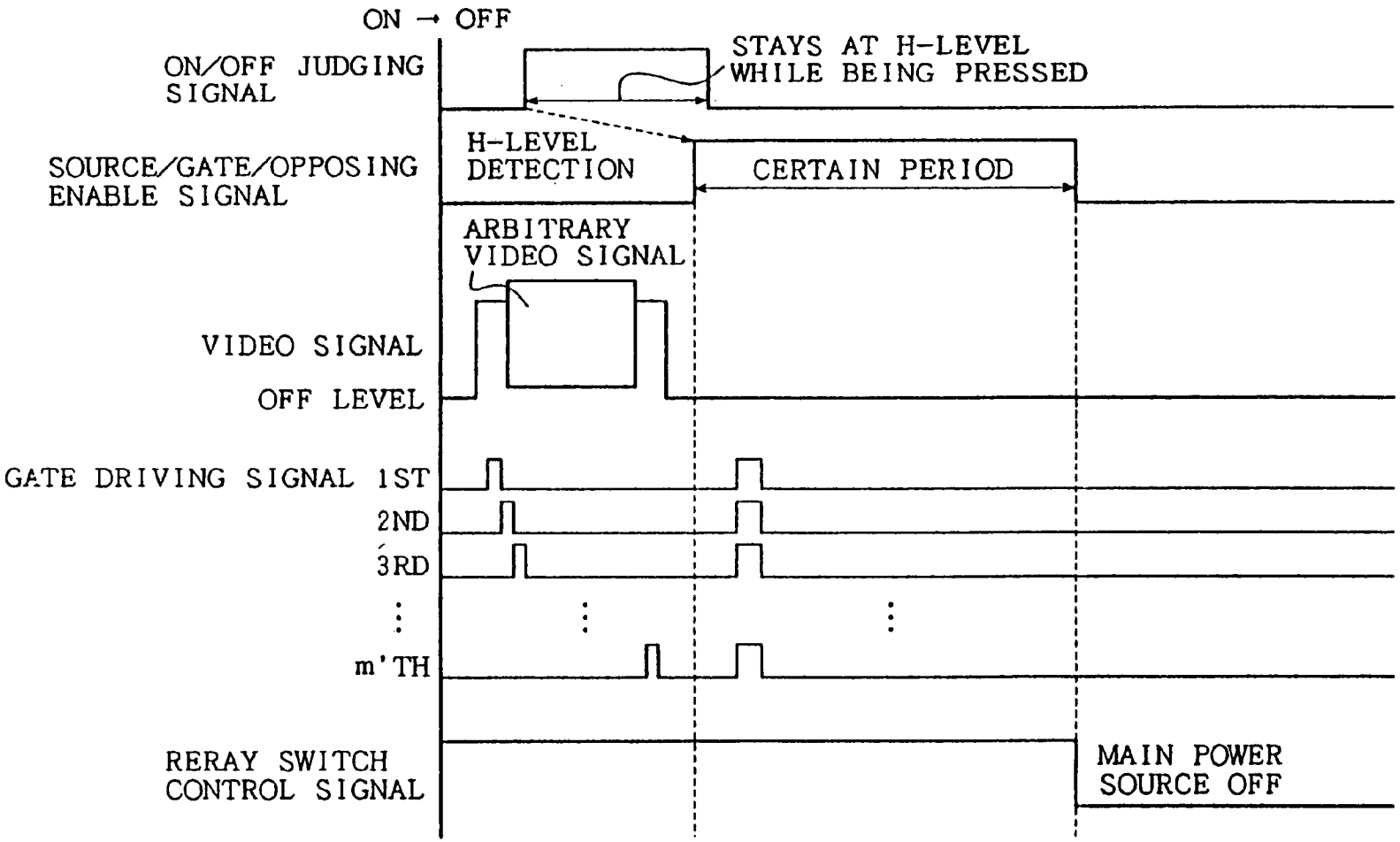
Figure 18:
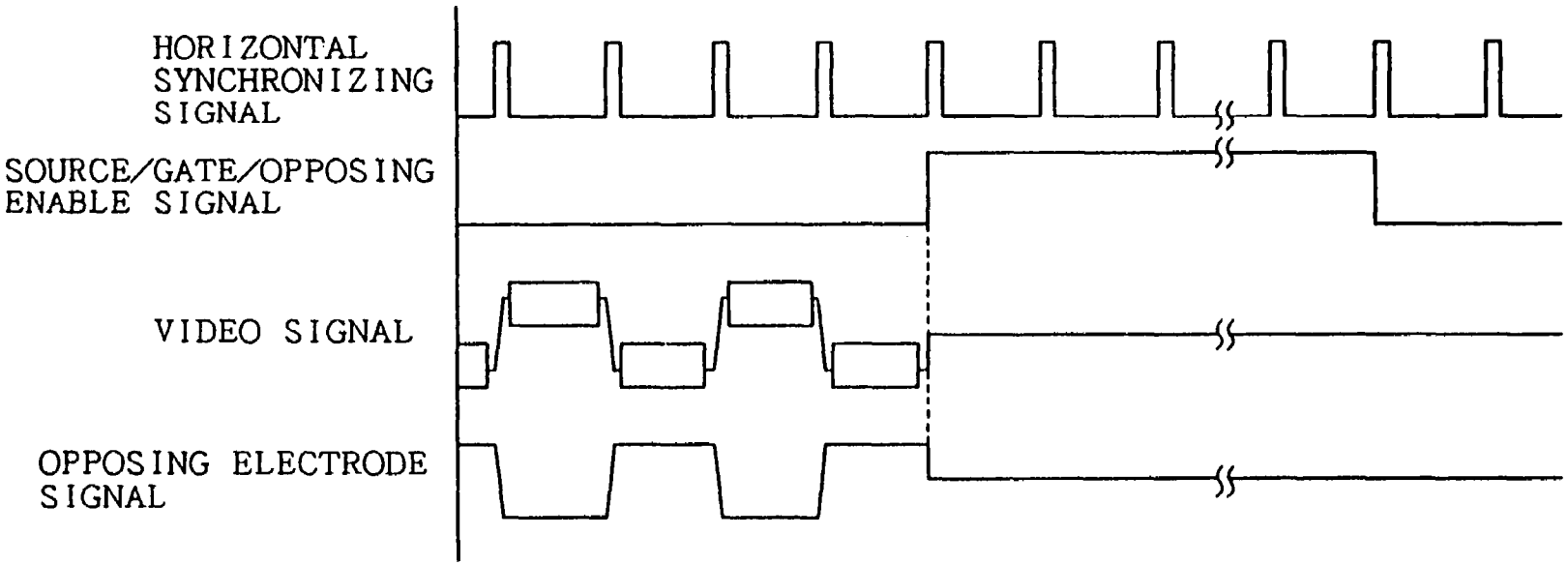

Herein, the video signal and opposing electrode signal are made into the rectangular wave signals and the polarity of these signals is inverted for every horizontal period. However, the present invention is not limited to the above arrangement. For example, as shown in FIG. 17, the video signal may be composed of only a direct current component of a voltage that turns OFF the liquid crystal of the liquid crystal display panel 1, namely, a voltage below the threshold voltage of the liquid crystal (OFF-level). Moreover, as shown in FIG. 18, both the video signal and opposing electrode signal may be zero volt signals. In other words, any voltage will do as long as it does not switch ON the liquid crystal of each pixel 22 relatively when applied thereon. In short, any voltage below the threshold of the liquid crystal will do.

Next, an example circuit of the gate driver 53 for realizing the above erasing action, and an example circuit of a video signal processing section in the source driver control circuit 54 will be explained with reference to FIGS. 19 through 24.

Figure 19:
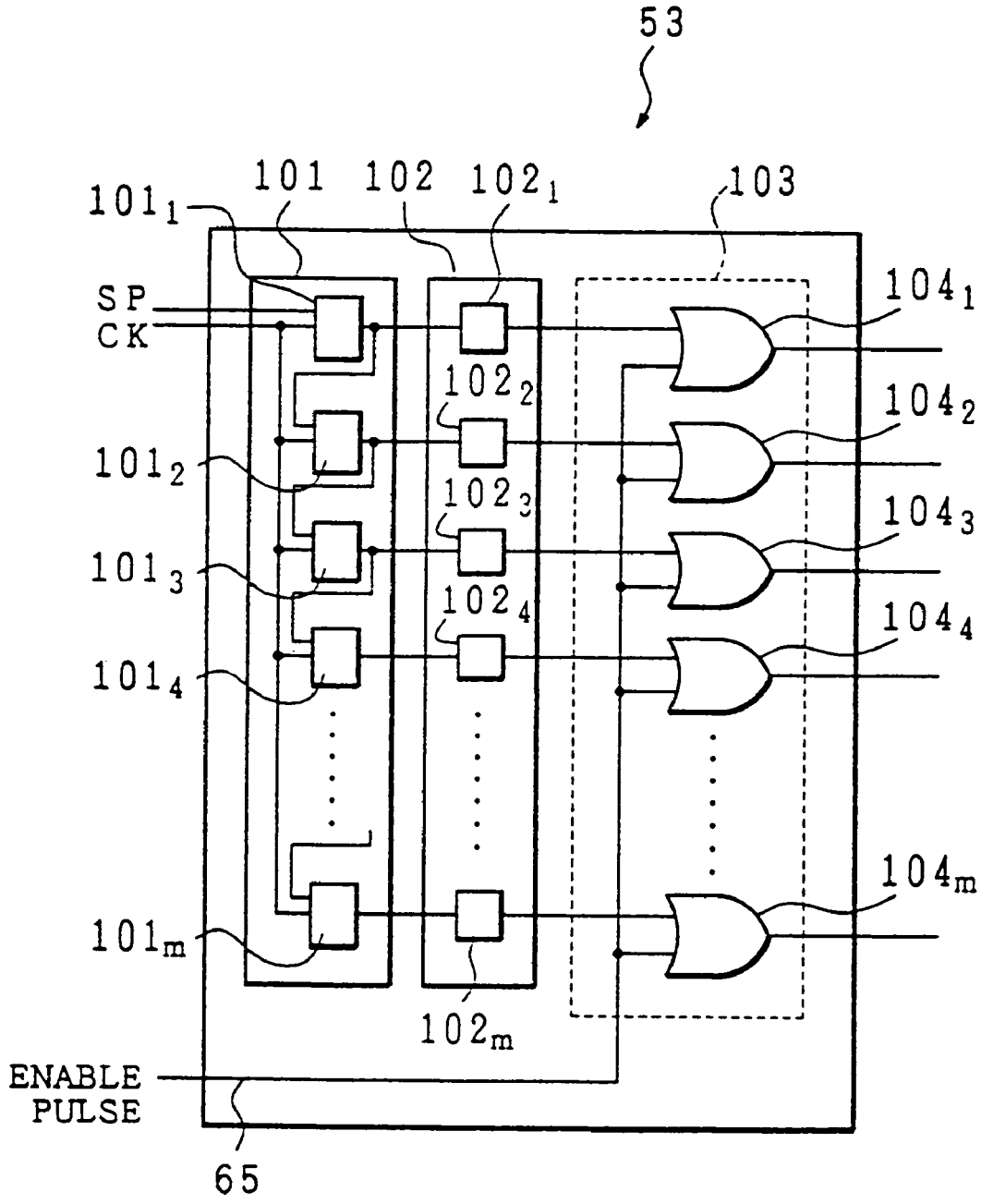
FIG. 19 is a view explaining an example arrangement of a gate driver in the liquid crystal display device of FIG. 13.

FIG. 19 is a view explaining an example gate driver 53. As shown in the drawing, the gate driver 53 has a standard arrangement for a gate driver, and includes a shift register 101, a level shifter 102, and a buffer circuit 103. Both the shift register 101 and level shifter 102 have m stages: the shift register 101 comprises registers $\mathbf{101}_1$-$\mathbf{110}_m$ and the level shift circuit 102 comprises level shift circuits $\mathbf{102}_1$-$\mathbf{102}_m$.

Herein, a horizontal synchronizing signal is supplied to the clock terminal of the registers $\mathbf{101}_1$-$\mathbf{101}_m$ as a clock signal (CK). A vertical synchronizing signal is supplied to the data terminal of the register $\mathbf{101}_1$ in the first stage of the shift register 101 as a start signal (SP). Pulses delayed sequentially by one horizontal period are outputted from the output terminals of the registers $\mathbf{101}_1$-$\mathbf{101}_m$ separately, which are inputted respectively to the level shift circuits $\mathbf{102}_1$-$\mathbf{102}_m$ of the level shift circuit 102, and outputted further to the buffer circuit 103 after being adjusted to an adequate level.

To carry out the above-described output for the erasing action, the buffer circuit 103 in the last stage comprises 2-input OR gates $\mathbf{104}_1$-$\mathbf{104}_m$. Either input of each of the OR gates $\mathbf{104}_1$-$\mathbf{104}_m$ is respectively connected to the outputs from the level shift circuits $\mathbf{102}_1$-$\mathbf{102}_m$, and the other input is connected to the enable pulse signal line 65.

Figure 20:
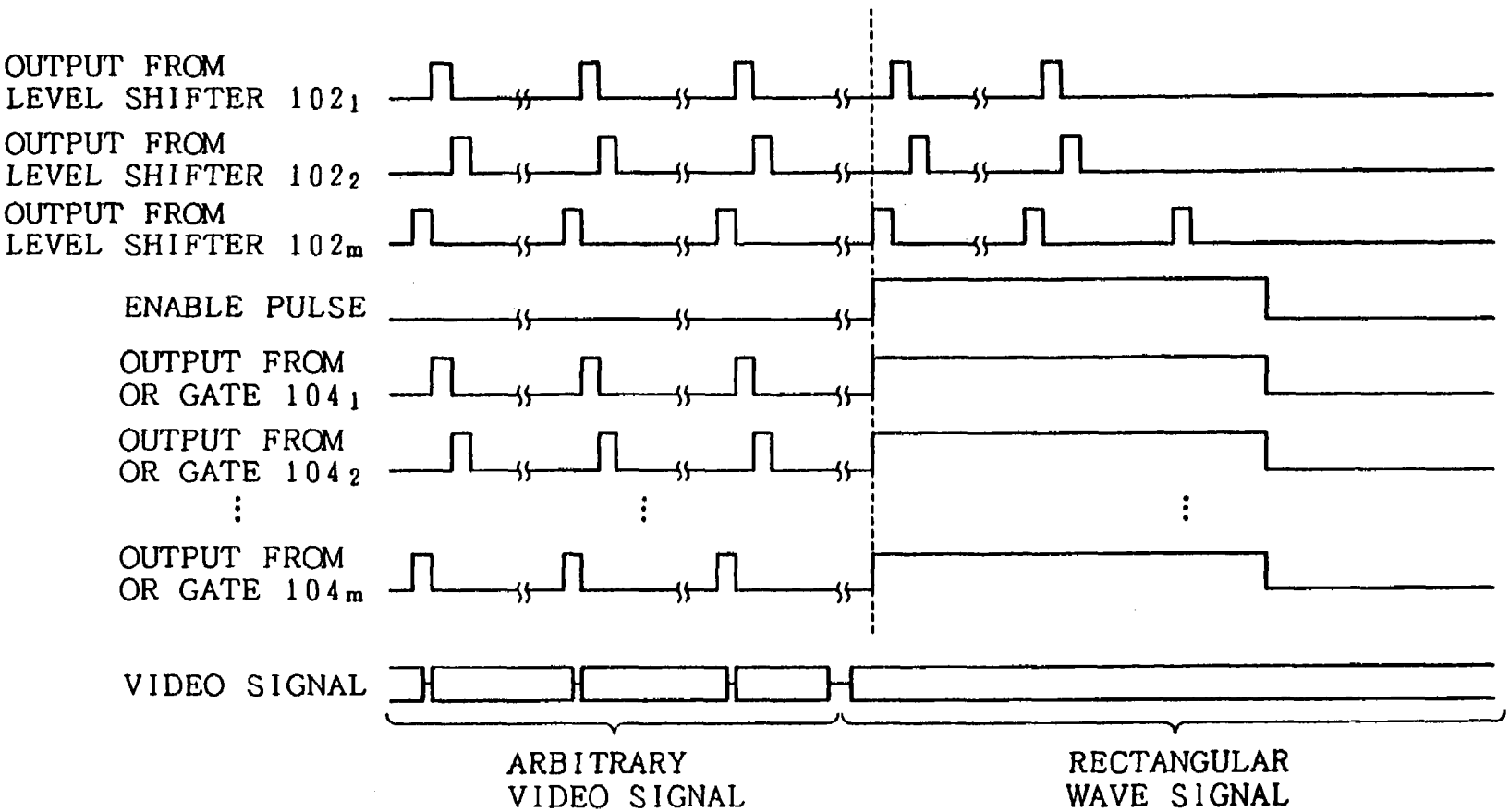
FIG. 20 is a view explaining signal waveforms of outputs from a major portion of the gate driver of FIG. 19.

FIG. 20 shows signal waveforms of a major portion of the gate driver 53 arranged as above. As shown in the drawing, the outputs from the gates $\mathbf{104}_1$-$\mathbf{104}_m$ forming the buffer circuit 103, in other words, the output from the gate driver 53, are the direct output from the level shifter 102 which turns ON the m gate lines sequentially, which is defined as the normal gate driving signal. The gate driver 7 of FIG. 2 converts the level of the input pulse and outputs the resulting pulse to the gate lines $\mathbf{25}_1$-$\mathbf{25}_m$ on the liquid crystal display panel 1.

On the other hand, upon input of the enable pulse through the enable pulse signal 65, the OR gates $\mathbf{104}_1$-$\mathbf{104}_m$ output the enable pulse directly instead of the outputs from the level shift circuits $\mathbf{102}_1$-$\mathbf{102}_m$, whereby all the TFTs 23 on the gate lines $\mathbf{25}_1$-$\mathbf{25}_m$ on the liquid crystal display panel 1 are turned ON concurrently.

Figure 21:
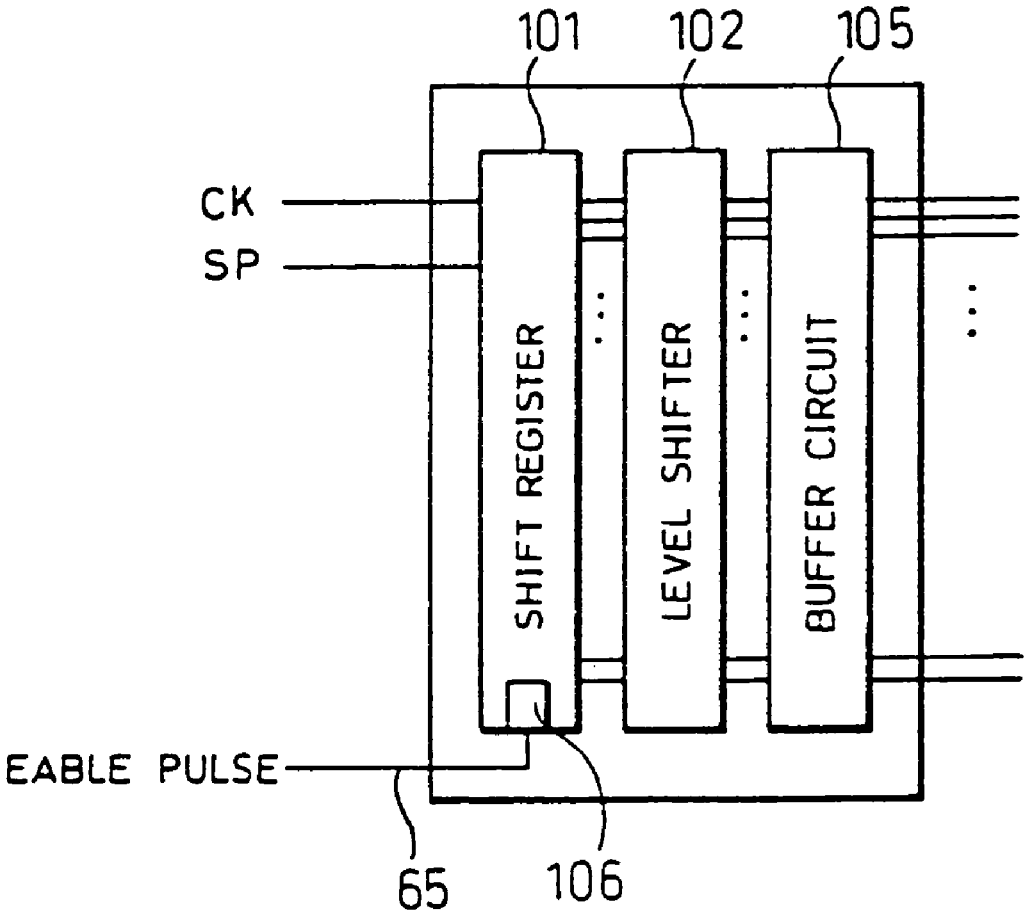
FIG. 21 is a view explaining another example arrangement of the gate driver in the liquid crystal display device of FIG. 13.

Another example gate driver 53 is illustrated in FIG. 21, which also includes a shift register 101, a level shifter 102, and a buffer circuit 105. Here, to carry out the above output for the erasing action, the shift register 101 includes a preset terminal 106, to which the enable pulse is inputted.

Figure 22:
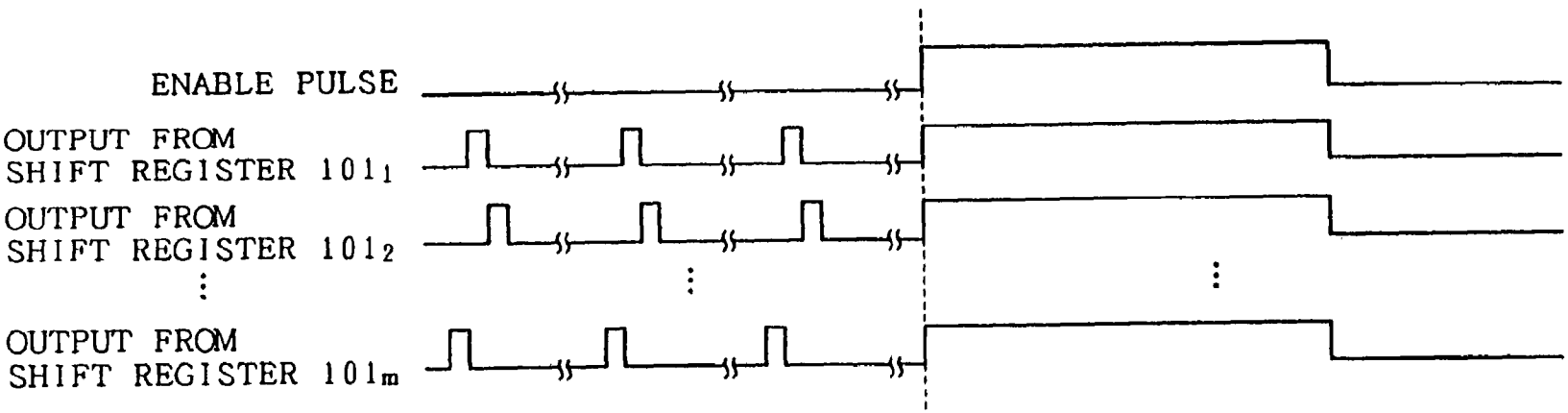
FIG. 22 is a view explaining signal waveforms of outputs from a major portion of the gate driver of FIG. 21.

FIG. 22 shows signal waveforms of a major portion of the gate driver 53 arranged as above. In a normal operation, the output from the shift register 101 is the output which sequentially turns ON the m gate lines. Upon input of the enable pulse to the preset terminal 106, the shift register 101 shifts the outputs from the registers $\mathbf{101}_1$-$\mathbf{101}_m$ in all the m stages in the shift register 101 to H-level regardless of the input to the shift register 101. Here, the gate driver control circuit 55 does not output any control signal but the enable pulse to the gate driver 53 after the gate enable signal has shifted to H-level.

Figure 23:
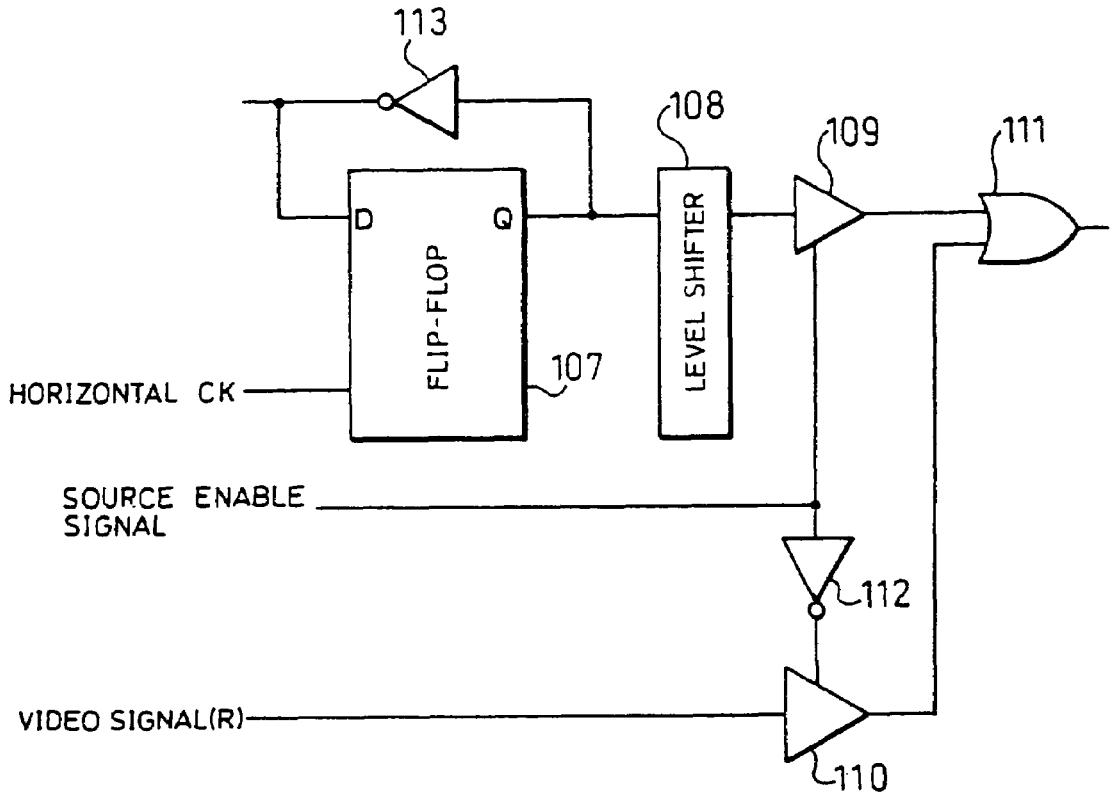
FIG. 23 is a view explaining an example circuit diagram of a video signal processing section in a source driver control circuit in the liquid crystal display device of FIG. 13.

FIG. 23 is a view explaining an example circuit of the video signal processing section in the source driver control circuit 54. As shown in the drawing, the video signal processing section includes a flip-flop 107, an inverter 113, a level shifter 108, 3-terminal buffers 109 and 110, another inverter 112, and an OR gate 111.

In this arrangement, the flip-flop 107 and inverter 113 generates a half-divided signal of the horizontal synchronizing signal, and output the same to the level shifter 108. The level shifter 108 converts the half-divided divided signal into a signal which is in phase with the opposing electrode signal at the same voltage level, and inputs the resulting signal to the 3-terminal buffer 109. In other words, the flip-flop 107, inverter 113, and level shifter 108 constitute a synchronized signal generating circuit.

Figure 24:
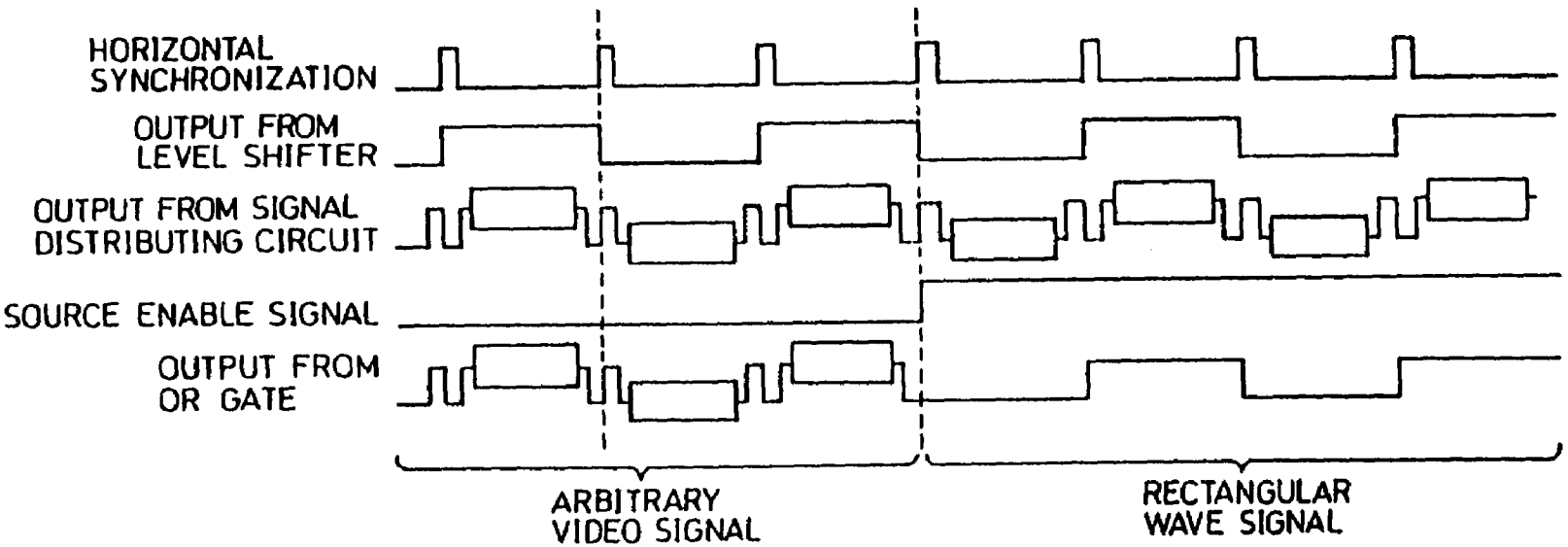
FIG. 24 is a view explaining waveforms of outputs from the video signal processing section of FIG. 23.

In a normal operation, the output from the OR gate 111 is the output from an unillustrated signal distributing circuit provided for each color in the source driver control circuit. However, upon input of the source enable signal, the 3-terminal buffers 109 and 110 and inverter 112 switch to the half-divided signal converted by the level shifter 108, so that the same is outputted from the OR gate 111. In other words, the 3-terminal buffers 109 and 110, inverter 112, and OR gate 111 constitute a switching circuit. FIG. 24 shows waveforms or the output from the video signal processing section arranged as above.

In the present embodiment, the control of the opposing electrode signal is omitted, and the control on the video signal alone is described. However, the opposing electrode signal can be controlled in the same manner. As has been explained, if a voltage applied to the liquid crystal based on the video signal and opposing electrode signal is the one that does not turn ON the liquid crystal relatively, in other words, the one that is below the threshold, the erasing effect can be attained. Therefore, it is apparent that both the video signal and opposing electrode signal can be composed of the direct current components alone as long as the voltage obtained from these signals does not turn ON the liquid crystal relatively.

Sixth Embodiment

The following description will describe a sixth embodiment of the present invention. Hereinafter, like components are labeled with like reference numerals with respect to the above embodiments, and the description of these components is not revealed or the explanation's convenience.

Figure 25:
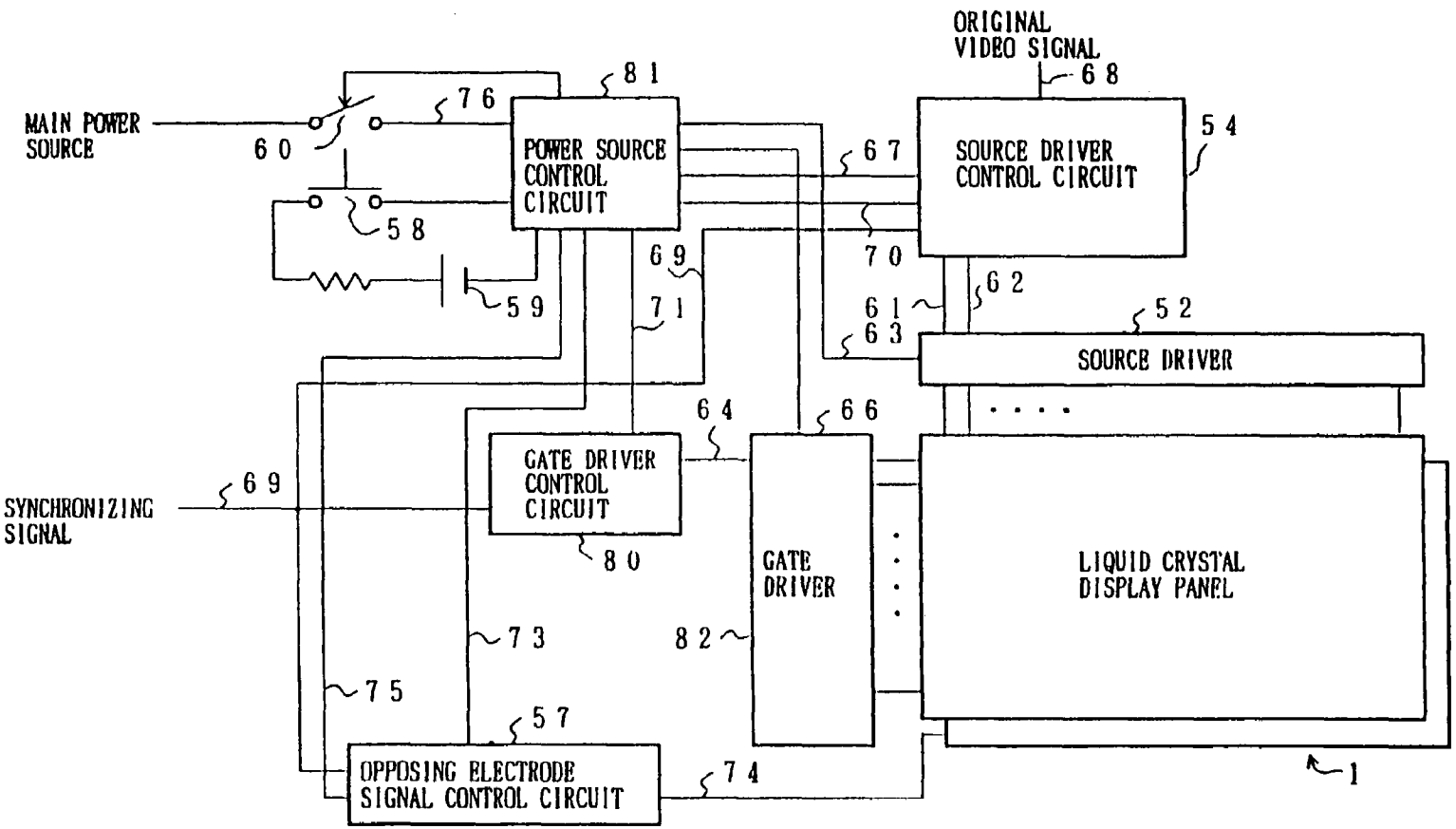
FIG. 25 is a block diagram depicting an arrangement of a liquid crystal display device in accordance with a sixth embodiment of the present invention.

FIG. 25 is a block diagram depicting an arrangement of a liquid crystal display device in accordance with the present embodiment (hereinafter, referred to as the present liquid crystal display device). In the counterpart in the fifth embodiment shown in FIG. 13, the gate enable signal is supplied to the gate driver control circuit 55 from the power source control circuit 56 through the gate enable signal line 72, and the gate driver control circuit 55 generates the gate enable pulse based on the input gate enable signal and supplies the gate enable pulse to the gate driver 53 through the enable pulse signal line 65.

In contrast, as shown in FIG. 25, in the present liquid crystal display device, a power source control circuit 81 does not output the gate enable signal, and the gate enable signal is not supplied to the gate driver control circuit 80. Herein, the enable signal is supplied to the source driver control circuit 54 and opposing electrode signal control circuit 57 alone. In other words, the gate driver control circuit 80 and a gate driver 82 in the gate side are arranged in the conventional manner.

Thus, erasing means of the present liquid crystal display device comprises the power source control circuit 81, source driver control circuit 54, source driver 52, and opposing electrode signal control circuit 57.

Figure 26:
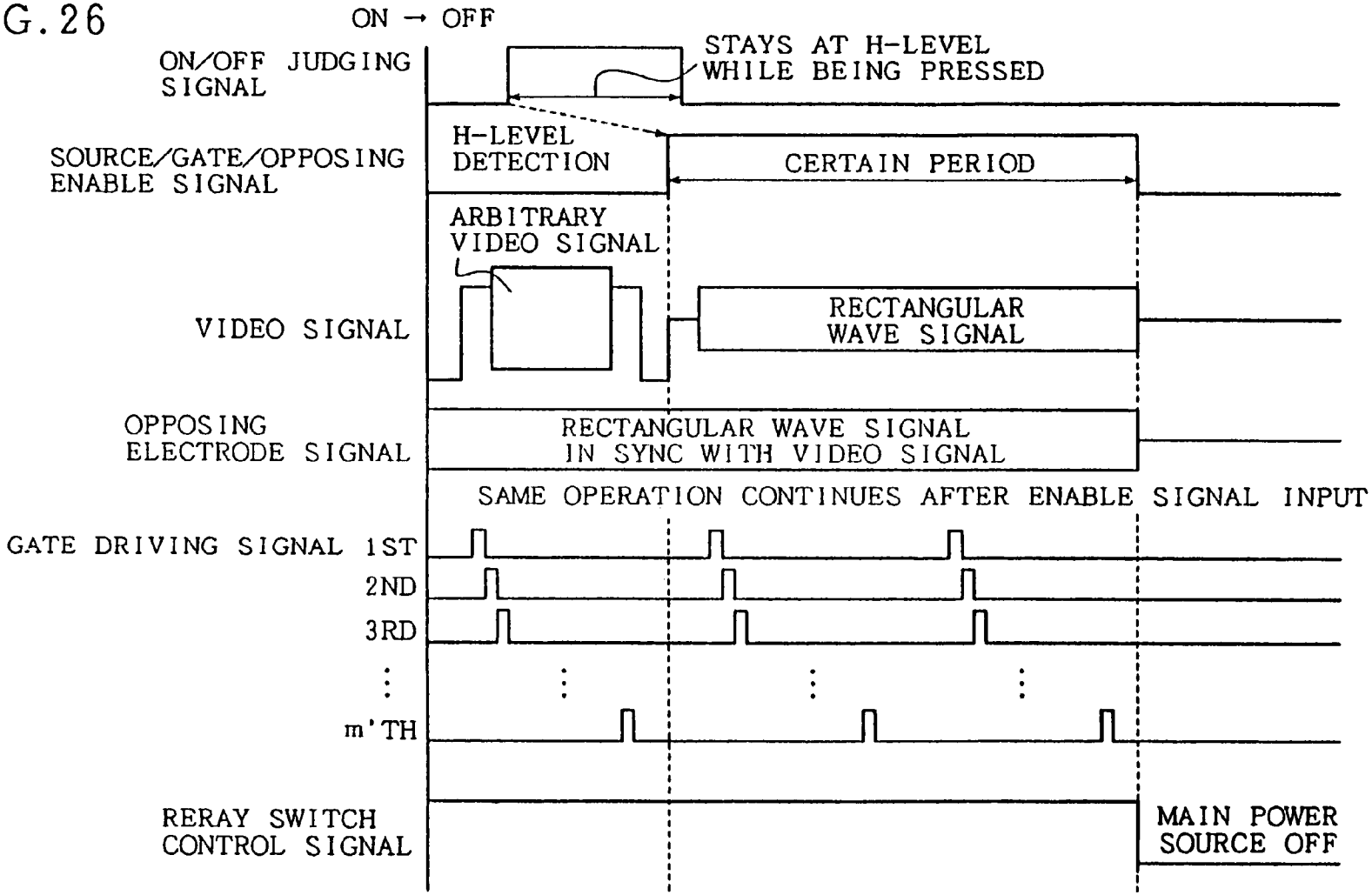

FIG. 26 shows signal waveforms of a major portion of the present liquid crystal display device arranges as above when being switched OFF from ON.

As shown in the drawing, the source driver control circuit 54 and opposing electrode signal control circuit 57 respectively keep outputting a normal video signal and a normal opposing electrode signal until the source enable signal and opposing enable signal are shifted to H-level with the pressing of the judging switch 58. Once the enable signals have shifted to H-level, the source driver control circuit 54 and opposing electrode signal control circuit 57 respectively output rectangular wave signals, which are in phase with each other at the same voltage level, instead of the normal signals in the same manner as the fifth embodiment.

The present liquid crystal display device is different from the counterpart in the fifth embodiment in that the gate driver 82 keeps outputting the normal gate driving signal when the present liquid crystal display device is switched OFF from ON, so as to keep turning ON the TFTs 23 on the gate lines $\mathbf{25}_1$-$\mathbf{25}_m$ sequentially per line.

According to the above arrangement, a voltage applied to the pixels 22 within one vertical period is reduced to relatively a zero volt, and the liquid crystal in each pixel 22 loses an applied voltage concurrently and the liquid crystal display panel 1 is shut off entirely, thereby erasing an afterimage in the liquid crystal (see FIG. 2).

If the gate enable signal is arranged not to be inputted to the gate side like in the present liquid crystal display device, a time required for erasing an afterimage is at least one horizontal period, which is longer than the time required in the counterpart in the fifth embodiment. However, the present liquid crystal display device is advantageous in that the gate driver 82 and gate driver control circuit 80 in the gate side can be of the existing models.

Like in the fifth embodiment, waveforms of the video signal and opposing electrode signal are not especially limited as long as a voltage applied to the pixels 22 is the one that does not turn ON the liquid crystal relatively, in other words, the one that is below the threshold.

Seventh Embodiment

The following description will describe a seventh embodiment of the present invention. Hereinafter, like components are labeled with like reference numerals with respect to the above embodiments, and the description of these components is not repeated for the explanation's convenience.

Figure 27:
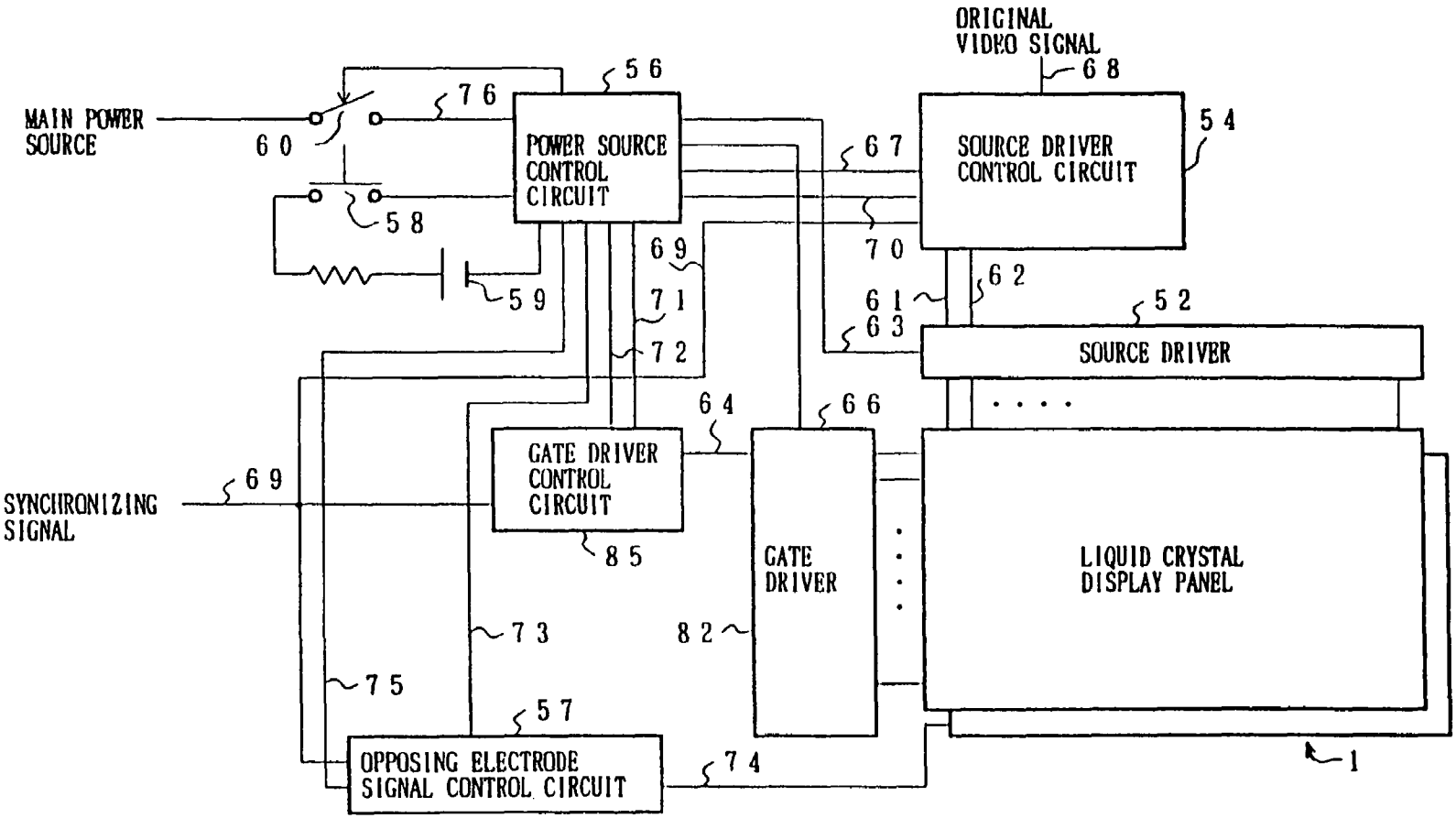
FIG. 27 is a block diagram depicting an arrangement of a liquid crystal display device in accordance with a seventh embodiment of the present invention.

FIG. 27 is a block diagram depicting an arrangement of a liquid crystal display device in accordance with the present embodiment (hereinafter, referred to as the present liquid crystal display device). In the counterpart in the fifth embodiment, upon input of the H-level in the gate enable signal line 72 from the power source control circuit 56, the gate driver control circuit 55 supplies the enable pulse to the gate driver 53 through the enable pulse signal 65, and the gate driver 53 outputs the enable pulse directly to all the gate lines $\mathbf{25}_1$-$\mathbf{25}_m$ concurrently instead of the normal gate driving signal upon input of the enable pulse.

In contrast, as shown in FIG. 27, in the present liquid crystal display device, upon input of the H-level gate enable signal from the power source control circuit 56, a gate driver control circuit 85 outputs the same directly to a gate driver 82 as a start signal (SP) through the gate control signal line 64.

In other words, erasing means of the present liquid crystal display device comprises the power source control circuit 56, source driver 52, gate driver 82, source driver control circuit 54, and gate driver control circuit 85.

Figure 28:
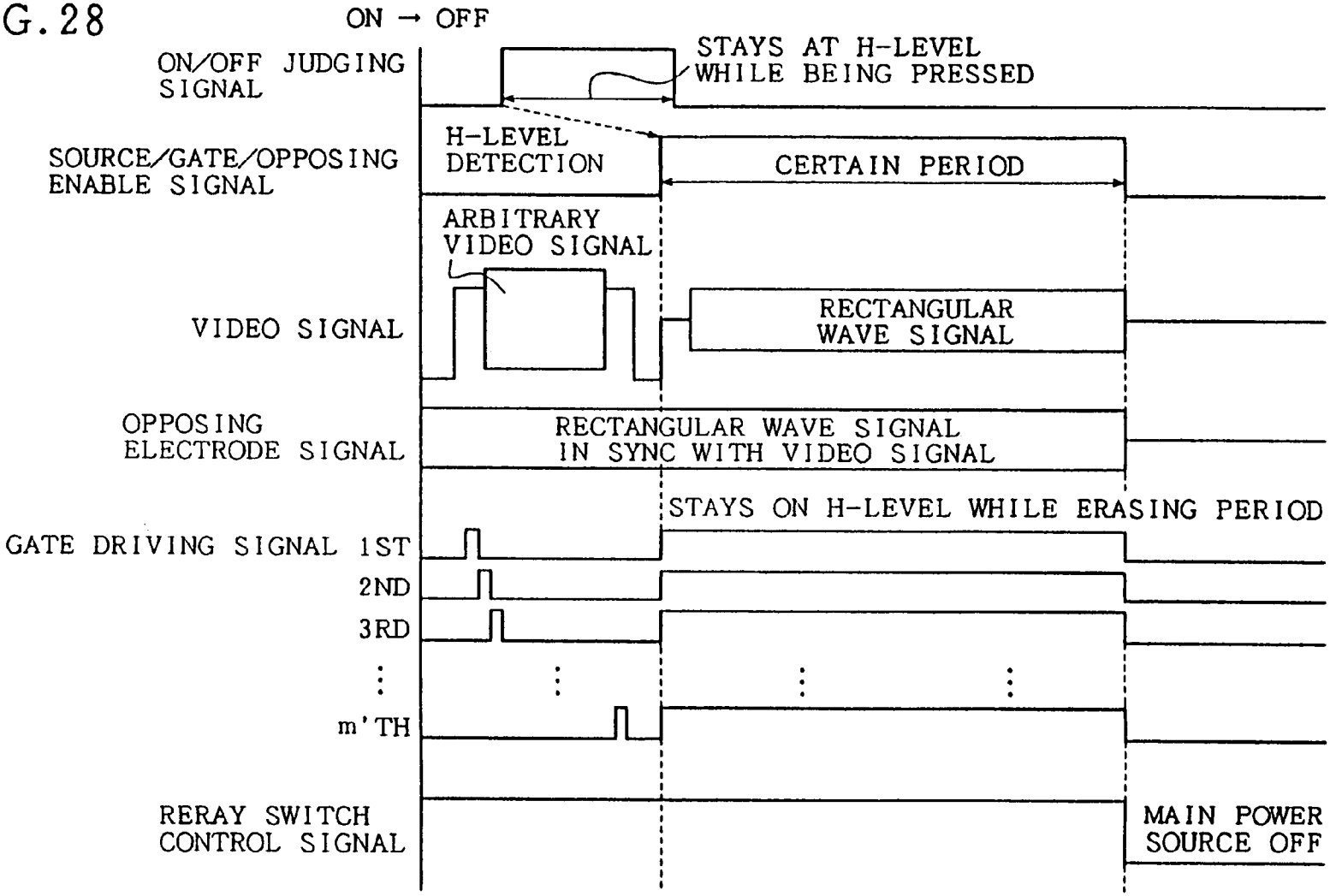

FIG. 28 shows signal waveforms of a major portion of the present liquid crystal display device arranged as above when being switched OFF from ON.

As shown in the drawing, the source driver control circuit 54 and opposing electrode signal control circuit 57 respectively keep outputting a normal video signal and a normal opposing electrode signal until the source enable signal and opposing enable signal are shifted to H-level with the pressing of the judging switch 58. When the enable signals have shifted to H-level, the source driver control circuit 54 and opposing electrode signal control circuit 57 output rectangular wave signals, which are in phase with each other at the same voltage level, instead of the normal signals in the same manner as the fifth embodiment.

The present liquid crystal display device is different from the counterpart in the fifth embodiment in that the gate driver 82 outputs the H-level gate driving signal while the gate enable signal stays at H-level. A H-level voltage value in the driving signal depends on the power source voltage.

Accordingly, the voltage applied to the pixels 22 drops to relatively zero after one horizontal period, and the voltage application to the liquid crystal in all the pixels 22 stops concurrently. As a result, the liquid crystal in each pixel 22 loses an applied voltage concurrently and the liquid crystal display panel 1 is shut off entirely, thereby erasing an afterimage in the liquid crystal (see FIG. 2).

In an arrangement where the output of the gate driver 82 is fixed to a certain voltage while the gate enable signal is being inputted like in the present liquid crystal display device, the time required for the erasing action can not be as short as the time required by the counterpart in the fifth embodiment, but can be shorter than the time required by the counterpart in the sixth embodiment. Moreover, there is an advantage that the gate driver 82 can be an existing model.

Like in the fifth embodiment, waveforms of the video signal and opposing electrode signal are not especially limited as long as a voltage applied to the pixels 22 is the one that does not turn ON the liquid crystal relatively, in other words, the one that is below the threshold.

Next, an example gate driver control circuit 85 which can operate in the above manner will be explained with reference to FIGS. 29 and 30.

Figure 29:
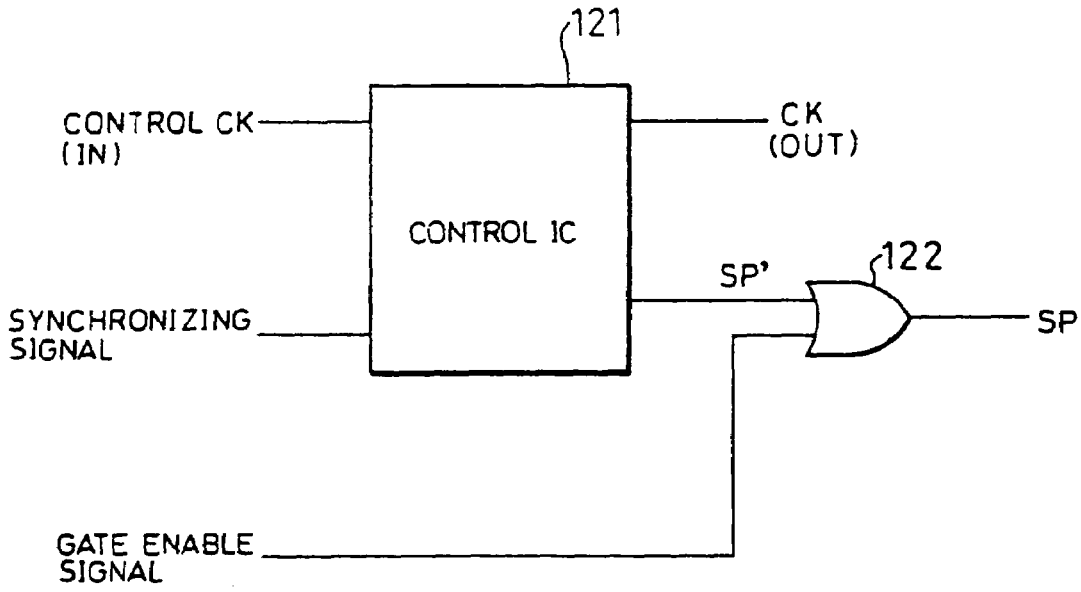
FIG. 29 is a view explaining an example gate driver control circuit in the liquid crystal display device of FIG. 27.
Figure 30:
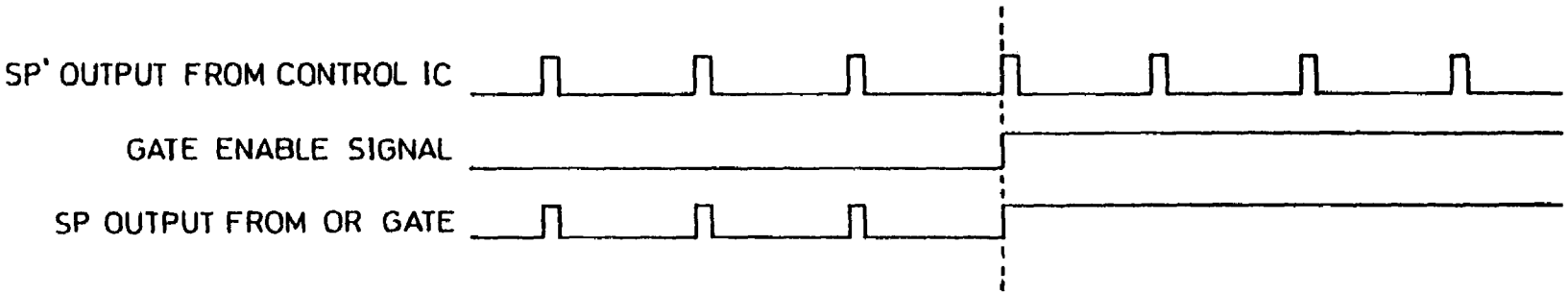
FIG. 30 is a view explaining signal waveforms in the gate driver control circuit of FIG. 29.
Figure 31:
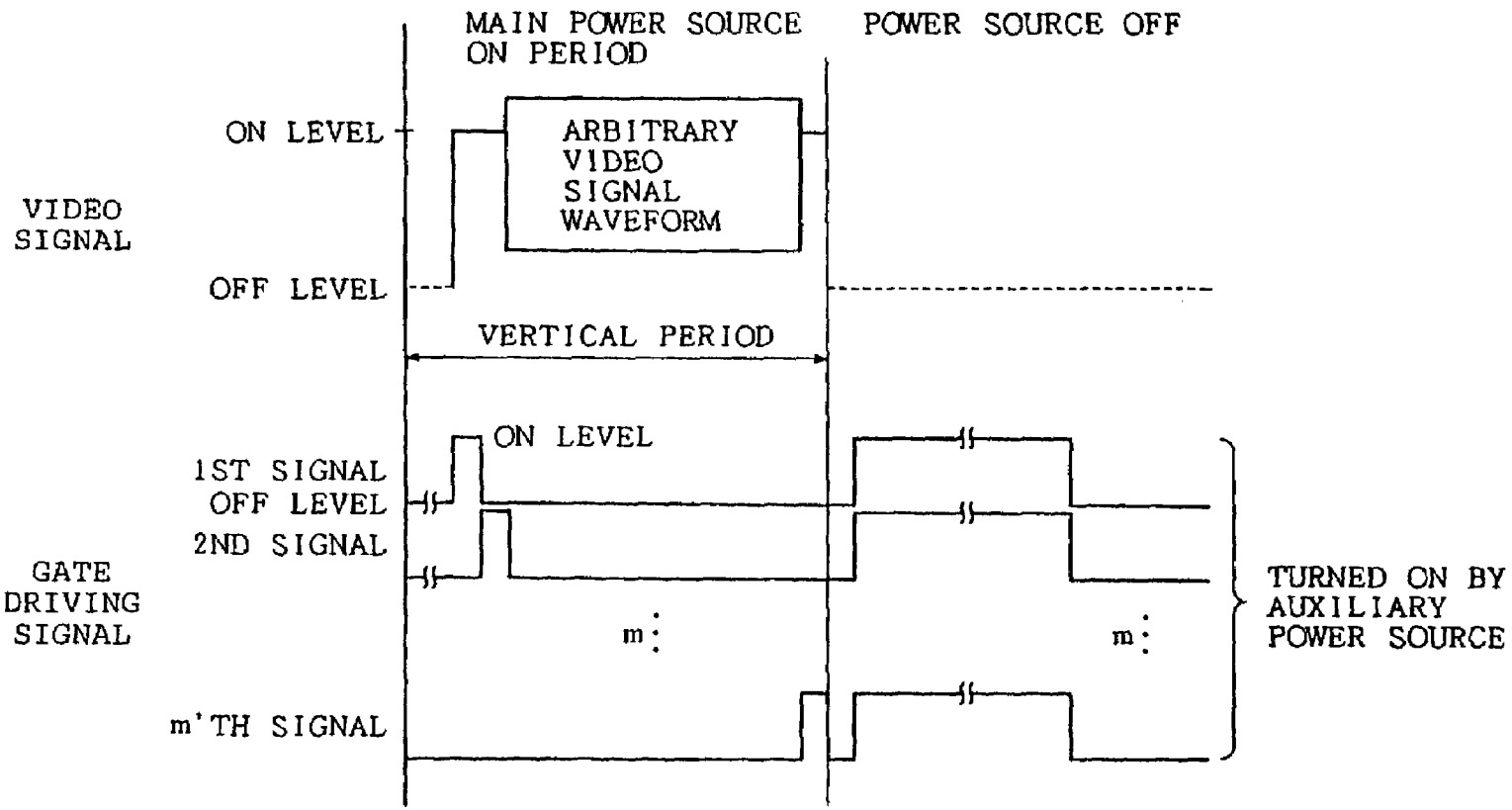
FIG. 31 is a view explaining waveforms of driving signals applied to a liquid crystal display panel when the main power of a conventional liquid crystal display device is turned OFF.

FIG. 29 is a view explaining an example gate driver control circuit 85. As shown in the drawing, the gate driver control circuit 85 includes a control IC121 as the standard model does. The control IC121 generates a signal for controlling the gate driver based on the input clock signal, horizontal synchronizing signal, vertical synchronizing signal, etc. Of all kinds of the control signals, a start signal (SP') and the gate enable signal obtained through the gate enable signal line 72 are inputted to the OR gate 122, which outputs a new start signal (SP). It is these start signals that make the erasing action possible. FIG. 30 shows a waveform of each kind of signal in the gate driver control circuit 85.

In the fifth through seventh embodiments, a dry cell, a button cell or the like is used as the judging power source 59. However, a battery charger may be used as the judging power source 59, and in this case, the battery charger is charged by the main power source for driving the main body of the present liquid crystal display device while the main body is operating. Particularly, since the liquid crystal devices, such as a notebook personal computer and a portable information terminal, adopt the battery charger for detecting ON/OFF of the main power source in the standard models, a separate button cell or dry cell can be omitted.

Further, the liquid crystal display device which is always supplied with power from the main power source like an A/C power source, such as a desk-top information terminal, can omit a separate button cell or dry cell like the case adopting the battery charger, if arranged in such a manner that the judging power source 59 is supplied with A/C power besides a voltage supplied through the main power source 76. In this case, it is more preferable to pre-install a small cell as an emergency power source as an assurance against an unexpected stop of the power supply, such as a power failure.

The ON/OFF control of so-called consumer electronic equipment (which is referred to as the ON/OFF control of the power source in the above explanation) is generally carried out not by a lock switch, such as a toggle switch, but by the pressing of an unlock key-switch like the judging switch 58, such as a tactile switch, for establishing or disconnecting the connection systematically. The unlock key switch outputs a strobe signal from the output terminal, and when the key switch is pressed, the strobe signal is inputted into the input terminal, whereupon the power output of the device is switched ON/OFF. In this arrangement, the power from the main power source can be readily cut with a certain delay since the device is switched OFF from ON as described above.

As has been explained, an erasing device for a liquid crystal display image, provided in a liquid crystal display device having a liquid crystal display panel whose pixels are driven by active elements, for erasing a display image on the liquid crystal display panel when a power source of a main body of the liquid crystal display device is turned OFF, is characterized by comprising:

power source OFF detecting means for detecting whether the power source of the main body of the liquid crystal display device is turned OFF or not;

panel power maintaining means for supplying power to the liquid crystal display panel for a certain period after the power source of the main body of the liquid crystal display device is turned OFF; and erasing means for lighting up the liquid crystal display panel entirely on a saturation voltage of liquid crystal and subsequently shutting off the liquid crystal display panel entirely using the power supplied from the panel power maintaining means source when the power source OFF detecting means detects that the power source of the main body of the liquid crystal display device is turned OFF.

According to the above arrangement, when the power source of the main body of the liquid crystal display device is turned OFF, the power source OFF detecting means detects the turning OFF of the main power source, and the panel power maintaining means maintains the power supplied to the liquid crystal display panel after the power source of the main body of the liquid crystal display device is turned OFF. Consequently, it has become possible to drive the liquid crystal display panel after the power source of the main body of the liquid crystal display device is turned OFF.

Also, when the power source OFF detecting means detects the turning OFF of the power source, the erasing means lights up the liquid crystal display panel entirely on the saturation voltage of the liquid crystal and subsequently shuts off the same entirely using the power supply from the panel power maintaining means.

Accordingly, even if a half-tone image is being displayed on the liquid crystal display panel when the power source of the main body of the liquid crystal display device is turned OFF and an amount of the restoring energy of the liquid crystal is small because the distortion is minor, the saturation voltage is applied to the liquid crystal of the liquid crystal display panel to increase an amount of the restoring energy to a satisfactory level. Thus, when the liquid crystal display panel is shut off entirely after being lit up entirely, the liquid crystal returns to its initial state quickly, thereby erasing an afterimage as soon as possible.

In this case, an afterimage can be erased faster if the liquid crystal display panel is driven in such a manner that a voltage which turns OFF the liquid crystal is applied to the liquid crystal when lighting up and subsequently shutting off the liquid crystal display panel entirely.

Figure 32B:
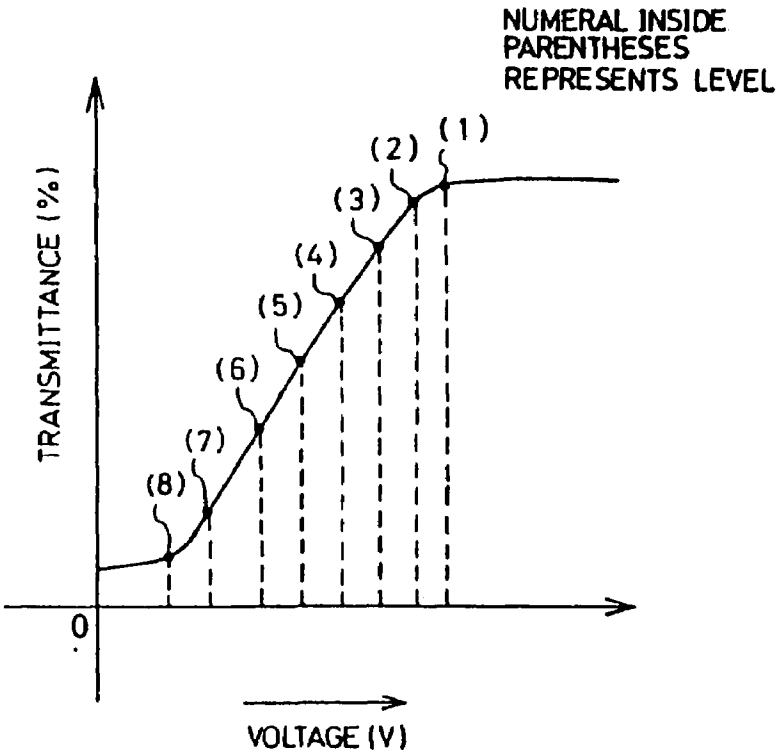
FIG. 32(*a*) is a graph showing a relation between a level interval and a response rate of liquid crystal.
Figure 32A:
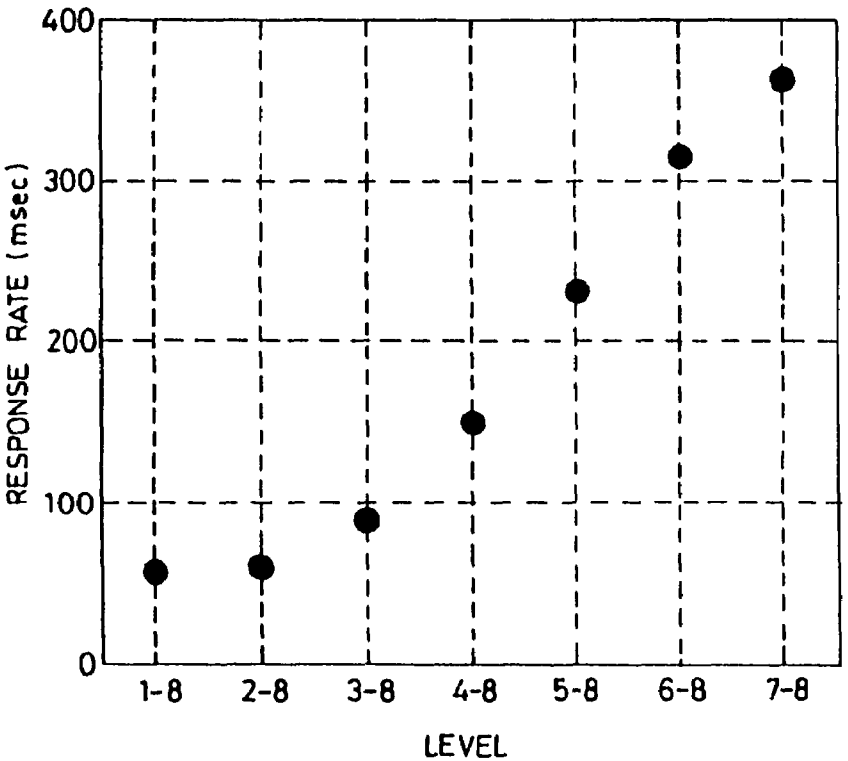

As shown in FIGS. 32(*a*) and 32(*b*), for example, when the power source of the main body is turned OFF while the liquid crystal display panel was displaying an image at the level 6, it used to take 320 msec for the liquid crystal display panel to return to the display state of the level 8. However, if the saturation voltage is applied to the liquid crystal display panel to make the display state to the level 1 preliminary like in the erasing device for a liquid crystal display image of the present invention, it takes only 70 msec to erase an afterimage.

If the TFTs (Thin Film Transistors) are used as the active elements, liquid crystal with high maintaining ability is required, and in general, liquid crystal with high specific resistance ($1\times10^{12}\Omega\cdot$cm) is used. The liquid crystal with high specific resistance takes a long time to discharge the charges, and it is more difficult to erase an afterimage. However, applying a saturation voltage before applying a voltage which turns OFF the liquid crystal in the above manner is very effective in such a case.

If an afterimage on the liquid crystal display panel is erased quickly, the charges withheld in the liquid crystal are discharged in a short time, thereby making it possible to suppress the deterioration of the liquid crystal due to an abnormal voltage.

The erasing device for a liquid crystal display image of the present invention may be arranged in such a manner that the erasing means outputs (1) a gate driving signal which sequentially turns ON gate lines to turn ON the active elements per gate line for a certain period not shorter than one vertical period by means of a gate driver and (2) a first video signal which lights up the liquid crystal display panel entirely by means of a source driver during the certain period, and after which the erasing means outputs (3) the gate driving signal which sequentially turns ON the gate lines to turn ON the active elements per gate line for the certain period not shorter than one vertical period by means of the gate driver again and (4) a second video signal which shuts off the liquid crystal display panel entirely by means of the source driver for the certain period.

According to the above-arranged example erasing means, the liquid crystal display panel is lit up entirely for the first certain period not shorter than one vertical period and subsequently shut off entirely for the second certain period not shorter than one vertical period by driving the gate driver and source driver in the above manner. Thus, the arrangement of the erasing means can be simplified.

The erasing device for a liquid crystal display image of the present invention may be arranged in such a manner that the erasing means includes:

a gate side compensating means for outputting a gate driving signal which turns ON the active elements on all gate lines concurrently in a vertical retrace lane period within one vertical period by means of a gate driver; and a source side compensating means for outputting a video signal which shuts off the liquid crystal display panel entirely by means of a source driver, the video signal being in sync with the gate driving signal outputted from the gate side compensating circuit, the erasing means lighting up the liquid crystal display panel entirely during the vertical retrace line period.

According to the above arrangement, the source side compensating means and gate side compensating means provided in the erasing means light up the liquid crystal display panel entirely during the vertical retrace line period within one vertical period when the power source of the main body of the liquid crystal display device is turned OFF. Thus, it has become possible to light up and shut off the liquid crystal display panel entirely within one vertical period, thereby erasing a liquid crystal afterimage faster while suppressing the deterioration of the liquid crystal more effectively.

Also, the erasing device for a liquid crystal display image of the present invention may be arranged in such a manner that the erasing means includes:

gate side compensating means for outputting a gate driving signal which turns ON the active elements on all gate lines concurrently over a vertical retrace line period within one vertical period by means of a gate driver; and source side compensating means for outputting a video signal which lights up and subsequently shuts off the liquid crystal display panel entirely by means or a source driver, the video signal being in sync with the gate driving signal.

According to the above arrangement, the source side compensating means and sate side compensating means provided in the erasing means light up and shut of the liquid crystal display panel entirely in a period shorter than one vertical period when the power source of the main body of the liquid crystal display device is turned OFF. Consequently, an liquid crystal afterimage can be erased faster, and the deterioration of the liquid crystal can be suppressed more effectively.

Also, the erasing device for a liquid crystal display image of the present invention may further comprise video signal distributing means for distributing a composite multi-color video signal into a plurality of mono-color video signals, wherein the source side compensating means is provided to an input side of the video signal distributing means for each color.

According to the above arrangement, the source side compensating means generates the video signal which lights up the liquid crystal display panel entirely in sync with the gate driving signal outputted from the gate side compensating means in the form of a multi-color composite video signal. Compared with a case where the video signal which lights up the liquid crystal display panel entirely is generated after the video signal is distributed into mono-color video signals, the arrangement of the source side compensating means can be simplified, and therefore, the erasing device can be downsized.

Also, an erasing device for a liquid crystal display image, provided in a liquid crystal display device having a liquid crystal display panel whose pixels are driven by active elements, for erasing a display image on the liquid crystal display panel when a power source of a main body of the liquid crystal display device is turned OFF, is characterized by comprising:

power source OFF detecting means for detecting whether the power source of the main body of the liquid crystal display device is turned OFF or not;

panel power maintaining means for supplying power to the liquid crystal display panel for a certain period after the power source of the main body of the liquid crystal display device is turned OFF; and erasing means for shutting off the liquid crystal display panel entirely by driving the liquid crystal display panel to apply a voltage which turns OFF the liquid crystal to the liquid crystal using the power supplied from the panel power maintaining means source when the power source OFF detecting means detects that the power source of the main body of the liquid crystal display device is turned OFF.

According to the above arrangement, when the power source of the main body of the liquid crystal display device is turned OFF, the power source OFF detecting means detects the turning OFF of the main power source, and the panel power maintaining means maintains the power from the power source supplied to the liquid crystal display panel after the power source of the main body of the liquid crystal display device is turned OFF. Consequently, it has become possible to drive the liquid crystal display panel after the power source of the main body of the liquid crystal display device is turned OFF.

Also, when the power source OFF detecting means detects the turning OFF of the power source, the erasing means passes the current through all the circuits driving the liquid crystal display panel for a certain period to turn ON the active elements, while at the same time controlling a video signal or an opposing electrode signal positively, so that a voltage which turns OFF the liquid crystal is applied to the liquid crystal.

According to the above arrangement, an afterimage can be erased quickly, and therefore, the charges withheld in the liquid crystal can be discharged in a short time, thereby suppressing the deterioration of the liquid crystal due to an abnormal voltage.

The aforementioned is the arrangement for increasing an amount of the restoring energy of the liquid crystal by applying the saturation voltage of the liquid crystal to erase an afterimage. However, in case of some kinds of liquid crystal, an afterimage can be erased quickly enough without applying the saturation voltage of the liquid crystal, and instead by shutting off the liquid crystal display panel entirely by controlling a video signal or an opposing electrode signal positively, so that a voltage which turns OFF the liquid crystal is applied to the liquid crystal while the active elements stay ON.

Also, the erasing device for a liquid crystal display image of the present invention may be arranged in such a manner that the erasing means outputs a gate driving signal which turns ON gate lines sequentially to turn ON the active elements per line by means of a gate driver, the erasing means also outputting a video signal applied to pixel electrodes and an opposing electrode signal applied to an opposing electrode of the liquid crystal panel by means of a source driver and an opposing electrode signal control circuit, respectively, both the video signal and the opposing electrode signal being applied as the voltage which turns OFF the liquid crystal.

According to the above arrangement, the gate driver outputs a signal which activates all the active elements concurrently. Thus, a time required to the erasing action can be reduced as short as half the horizontal period, thereby making it possible to erase an afterimage in a very short time.

Also, the erasing device for a liquid crystal display image of the present invention may be arranged in such a manner that the erasing means outputs a gate driving signal which turns ON the active elements on all gate lines concurrently by means of a gate driver, the erasing means also outputting a video signal applied to a pixel electrode and an opposing electrode signal applied to an opposing electrode of the liquid crystal panel by means of a source driver and an opposing electrode signal control circuit, respectively, both the video signal and the opposing electrode signal being applied as the voltage which turns OFF the liquid crystal.

According to the above arrangement, the active elements are sequentially turned ON per line in the normal manner. Thus, although it takes at least one vertical period to erase an afterimage, there is an advantage that the gate driver, driver control circuit, etc. or existing models can be used.

Also, the erasing device for a liquid crystal display image of the present invention may be arranged in such a manner that the erasing means outputs a gate driving signal within a fixed power source potential supplied to the gate driver to all the gate lines by means of the gate driver, and both a video signal applied to a pixel electrode by means of a source driver and an opposing electrode signal applied to an opposing electrode of the liquid crystal display panel by means of an opposing electrode signal control circuit as a voltage which turns OFF the liquid crystal.

According to the above arrangement, not only the erasing action can be accelerated, but also there is another advantage that the gate driver or an existing model can be used to output the gate driving signal.

Also, the erasing device for a liquid crystal display image of the present invention may be arranged in such a manner that:

a switch of the power source of the main body of the liquid crystal display device outputs a judging pulse every time being manipulated;

the power source OFF detecting means detects that the power source of the main body of the liquid crystal display device is turned OFF upon input of the judging pulse while the main body of the liquid crystal display device stays ON; and the panel power maintaining means turns OFF switch means after a predetermined period has passed since the power source detecting means detects that the power source is turned OFF, the switching means being provided on a main power source line for supplying power from a main power source of the main body of the liquid crystal display device.

The above power source switch is not a switch like a toggle switch that establishes or disconnects the connection mechanically, but a switch like a tactile switch that establishes or disconnects the connection systematically.

According to the above arrangement, the panel power maintaining means judges whether the power source is turned ON/OFF based on the judging pulse outputted from the power source switch. Thus, when the power source is switched OFF from ON, the switch means, which is provided on the main power source line and can control the power supply from the main power source means by establishing or disconnecting the connection using another control circuit, such as a relay switch, is turned OFF after a predetermined period has passed. Consequently, the panel power maintaining means can be realized systematically without forming a separate auxiliary power source or the like.

Also, the liquid crystal display device of the present invention is a reflective type which displays an image by reflecting incident light from the external and includes the above erasing device for a liquid crystal display image.

An afterimage is particularly noticeable on the reflective liquid crystal display device because there remains ambient light after the power source is turned OFF. However, a combination with the above erasing device can upgrade the display quality remarkably, thereby realizing a reflective liquid crystal display device with an excellent display quality.

Also, the liquid crystal display device or the present invention includes a Guest-Host liquid crystal display panel and the above erasing device for a liquid crystal display image.

The response rate of the Guest-Host liquid crystal is too slow to erase an afterimage at a satisfactory speed. However, a combination with the above erasing device makes it possible to erase an afterimage quickly. Thus, the display quality can be upgraded significantly, and a Guest-Host liquid crystal display device with an excellent display quality can be realized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An erasing device for a liquid crystal display image, provided in a liquid crystal display device having a liquid crystal display panel whose pixels are driven by active elements, for erasing a display image on said liquid crystal display panel when a power source of a main body of said liquid crystal display device is turned OFF, said erasing device comprising:

a power source OFF detection circuit detecting a command to turn OFF the power source of the main body of said liquid crystal display device;

panel power maintaining circuit supplying power to said liquid crystal display panel for a certain period after a command to turn OFF the power source of the main body of said liquid crystal display device is inputted; and an erasing circuit lighting up said liquid crystal display panel entirely on a saturation voltage of liquid crystal and subsequently shutting off said liquid crystal display panel entirely using the power supplied from said panel power maintaining circuit source when said power source OFF detection circuit detects a command to turn OFF the power source of the main body of said liquid crystal display device.

2. The erasing device for a liquid crystal display image of claim 1, wherein said erasing circuit drives said liquid crystal panel to apply a voltage which turns OFF said liquid crystal to said liquid crystal when turning OFF said liquid crystal display panel entirely after lighting up said liquid crystal display panel entirely.

3. The erasing device for a liquid crystal display image of claim 2, wherein said erasing circuit outputs (1) a gate driving signal which sequentially turns ON gate lines to turn ON the active elements per gate line for a certain period not shorter than one vertical period by means of a gate driver, and (2) a first video signal which lights up said liquid crystal display panel entirely by means of a source driver during said certain period, and after which said erasing circuit outputs (3) the gate driving signal which sequentially turns ON the gate lines to turn ON the active elements per gate line for said certain period not shorter than one vertical period by means of said gate driver again and (4) a second video signal which shuts off said liquid crystal display panel entirely by means of said source driver for said certain period.

4. The erasing device for a liquid crystal display image of claim 2, wherein said erasing circuit includes:

a gate side compensation circuit outputting a gate driving signal which turns ON the active elements on all gate lines concurrently in a vertical retrace line period within one vertical period a gate driver; and a source side compensation circuit outputting a video signal which shuts off said liquid crystal display panel entirely by means of a source driver, said video signal being in sync with said gate driving signal outputted from said gate side compensating circuit, said erasing circuit lighting up said liquid crystal display panel entirely during the vertical retrace line period.

5. The erasing device for a liquid crystal display image of claim 4 further comprising a video signal distributing circuit distributing a composite multi-color video signal into a plurality of mono-color video signals, wherein said source side compensation circuit is provided to an input side of said video signal distributing circuit for each color.

6. The erasing device for a liquid crystal display image of claim 2, wherein said erasing circuit includes:

gate side compensation circuit outputting a gate driving signal which turns ON the active elements on all gate lines concurrently over a vertical retrace line period within one vertical period by means of a gate driver; and a source side compensation circuit outputting a video signal which lights up and subsequently shuts off said liquid crystal display panel entirely by means of a source driver, said video signal being in sync with said gate driving signal.

* * * * *